US010382860B2

(12) United States Patent
Spillmann et al.

(10) Patent No.: US 10,382,860 B2
(45) Date of Patent: Aug. 13, 2019

(54) LOUDSPEAKER ACOUSTIC WAVEGUIDE

(71) Applicant: Harman International Industries, Incorporated, Stamford, CT (US)

(72) Inventors: Jacques Spillmann, Los Angeles, CA (US); Steven Patrick Riemersma, Woodland Hills, CA (US); Mark Thomas DeLay, St. Paul, MN (US)

(73) Assignee: Harman International Industries, Incorporated, Stamford, CT (US)

( * ) Notice: Subject to any disclaimer, the term of this patent is extended or adjusted under 35 U.S.C. 154(b) by 84 days.

(21) Appl. No.: 15/255,031

(22) Filed: Sep. 1, 2016

(65) Prior Publication Data

US 2018/0063636 A1 Mar. 1, 2018

(51) Int. Cl.

| | |
|---|---|
| ***H04R 1/32*** | (2006.01) |
| ***H04R 1/34*** | (2006.01) |
| ***H04R 1/40*** | (2006.01) |

(52) U.S. Cl.

CPC ..... *H04R 1/323* (2013.01); *H04R 1/345* (2013.01); *H04R 1/403* (2013.01); *H04R 2201/401* (2013.01)

(58) Field of Classification Search

CPC .. H04R 1/323; H04R 1/345; H04R 2201/401; H03R 1/403

USPC ..... 381/339

See application file for complete search history.

(56) References Cited

U.S. PATENT DOCUMENTS

| | | | | |
|---|---|---|---|---|
| 6,343,133 | B1 | 1/2002 | Adamson | |
| 7,278,513 | B2 | 10/2007 | Brawley, Jr. | |
| 8,130,994 | B2 * | 3/2012 | Button | H04R 1/24 181/155 |
| 9,245,513 | B1 * | 1/2016 | Dimitrov | H04R 1/345 |
| 2009/0310809 | A1 * | 12/2009 | Voishvillo | H04R 1/30 381/343 |
| 2011/0085692 | A1 * | 4/2011 | Voishvillo | H04R 1/30 381/343 |
| 2013/0182879 | A1 * | 7/2013 | Graber | H04R 1/345 381/343 |
| 2014/0262600 | A1 | 9/2014 | Hughes, II | |
| 2014/0270308 | A1 | 9/2014 | Donarski | |
| 2016/0212523 | A1 | 7/2016 | Spillmann et al. | |

OTHER PUBLICATIONS

ISA European Patent Office, International Search Report and Written Opinion Issued in Application No. PCT/US2017/049188, dated Nov. 14, 2017, WIPO, 13 pages.

* cited by examiner

*Primary Examiner* — Sean H Nguyen
(74) *Attorney, Agent, or Firm* — McCoy Russell LLP

(57) ABSTRACT

Examples are disclosed for a waveguide for a loudspeaker, the waveguide including a first and second outer shell coupled to one another, and a first and second inner shell coupled to one another and positioned within an air gap between the first and second outer shells, a plurality of sound paths being formed between an exterior surface of the first inner shell and an interior surface of the first outer shell and between an exterior surface of the second inner shell and an interior surface of the second outer shell, each of the plurality of sound paths having an equal path length in a plurality of planes.

15 Claims, 22 Drawing Sheets

LOUDSPEAKER ACOUSTIC WAVEGUIDE

FIELD

The disclosure relates to loudspeaker waveguides that provide pathways for sound output by acoustic elements of a loudspeaker.

BACKGROUND

Some types of loudspeakers may include a driver unit (for generating sound waves) connected to an outwardly expanding horn (for propagating the generated sound waves). In some loudspeakers, sound waves uniformly travel from the driver unit as a point source through the horn and outward in all directions. However, the resulting wave shape of sound output by such loudspeakers may direct sound toward locations including those that do not include listeners (e.g., a ceiling area above the listeners) and/or cause undesirable interactions with adjacent loudspeakers in a directional array. The portion of the acoustical power of the loudspeaker utilized to radiate sound waves upward above the loudspeaker or to cause interference in the desired listener locations is largely wasted in such scenarios.

SUMMARY

Embodiments are disclosed for a loudspeaker waveguide that achieves one or more of: providing substantially equal sound path lengths to create a flat and/or curved wave front from the exit of a compression driver, and providing a controlled cross-sectional area expansion rate from the inlet to the outlet of the waveguide. The above features may provide a loudspeaker output wave shape that propagates coherent sound waves in a controlled direction (e.g., toward an area of listeners), thereby reducing waste in sound output.

BRIEF DESCRIPTION OF THE DRAWINGS

The disclosure may be better understood from reading the following description of non-limiting embodiments, with reference to the attached drawings, wherein below.

DETAILED DESCRIPTION

In order to reduce the amount of sound directed from a loudspeaker to non-useful locations (e.g., areas away from a primary listening area, such as above the loudspeaker in some arrangements), a loudspeaker may be fitted with a horn that controls the propagation of sound to create a shape of sound output. For example, in an uncontrolled loudspeaker, a shape of the sound output may be spherical, or otherwise have equal sound radiation in all directions. Some loudspeakers may employ a waveguide or an array of waveguides to generate a substantially cylindrical output sound shape with controlled horizontal expansion and limited or no vertical expansion. However, other approaches to create such a sound output shape may utilize waveguides that use the vertical plane to create sound pathways having a similar or same length. The resulting waveguide may only feature in the horizontal plane a constant width from the inlet to the outlet of the waveguide, but differing (or more differing) path lengths in other planes. The present disclosure describes example waveguides and waveguide configuration techniques for waveguides that provide equal sound path lengths in substantially all directions to create equal length channels where sound can travel from a sound output source of the loudspeaker (e.g., an inlet of the waveguide) to a sound exit of the loudspeaker (e.g., an outlet of the waveguide). In this way, increased control may be provided over the sound propagation in relation to systems that utilize waveguides with equal path lengths in only one plane.

Figure 1A:
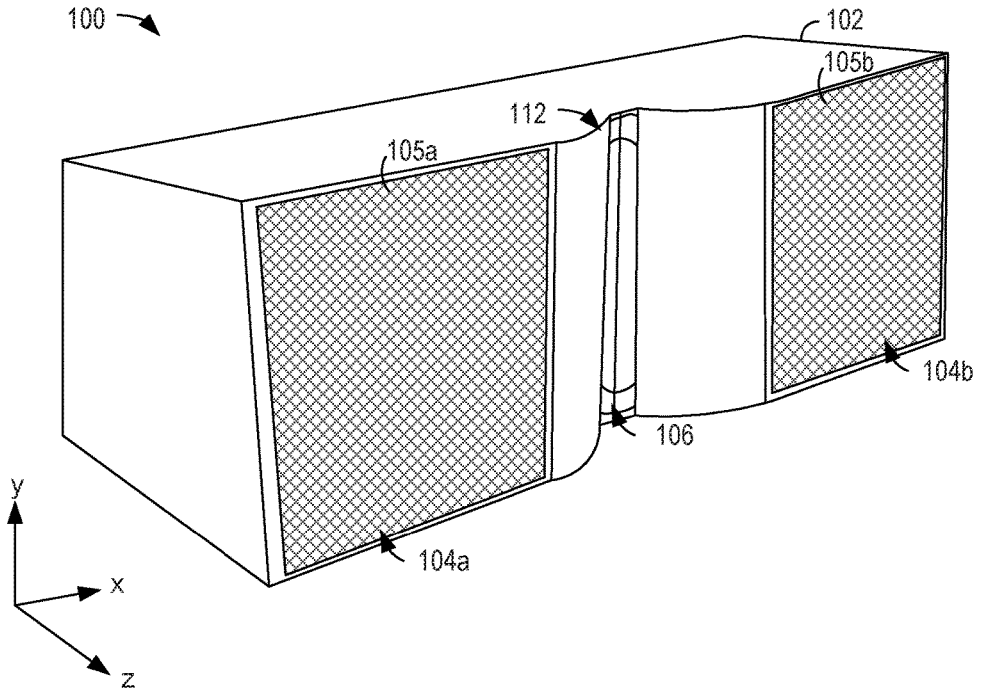
FIGS. 1A and 1B show different views of an example loudspeaker system in accordance with one or more embodiments of the present disclosure.
Figure 1B:
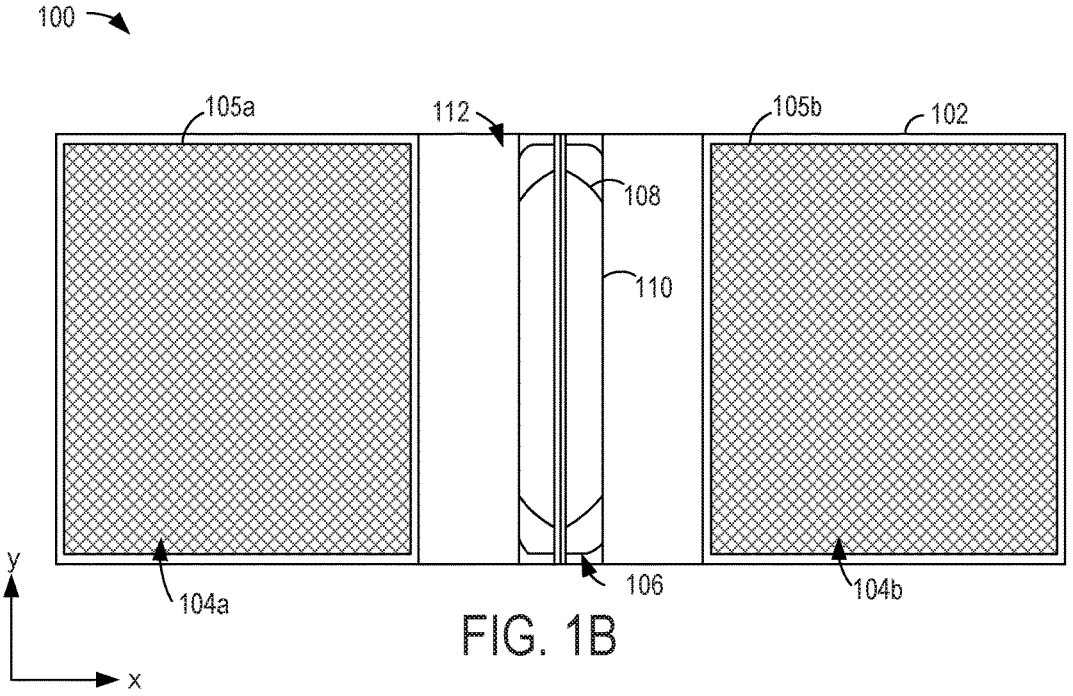

FIG. 1A is a projection view of a loudspeaker system 100. FIG. 1B is a front view of the loudspeaker system 100. The loudspeaker system 100 may include any device that converts input signals into sounds. For example, the loudspeaker system 100 may be configured to output sounds at a range of frequencies including those perceptible by a human ear (e.g., 20 Hz to 20 kHz).

The loudspeaker system may include a housing 102 that houses one or more audio-producing components. For example, in order to output sound in a wide range of frequencies, the loudspeaker system 100 may include a plurality of loudspeaker drivers (e.g., of different sizes). A largest size of loudspeaker driver includes woofers, which may reproduce low frequencies (e.g., about 1 kHz or less). A medium-sized loudspeaker driver includes mid-range loudspeaker drivers, which may reproduce middle frequencies (e.g., about 200 Hz to 2 kHz). The smallest size of loudspeaker includes compression drivers, which may reproduce high frequencies (e.g., about 1 kHz or more).

Loudspeaker system 100 provides one example arrangement of loudspeakers, including a pair of woofers 104*a* and 104*b* (e.g., shown covered by a grill 105*a* and 105*b*, respectively, which may include a tight mesh that permits audible sound to pass through and prevents dust and debris from entering the housing 102) positioned on opposing sides of at least one compression driver 106 within the housing 102.

As shown in more detail in the front view of the loudspeaker system 100 of FIG. 1B, the compression driver 106 may include a waveguide 108 configured to control the propagation of sound from the mid-range loudspeaker out of the loudspeaker system 100. For example, the waveguide 108 may be positioned in alignment with a slot or opening 110 of the housing 102, such that sound exiting the waveguide may not encounter interference from internal surfaces of structural components of the housing 102. In other words, the slot or opening 110 may be sized and shaped to allow outward-facing edges (e.g., edges facing a front exterior of the housing 102) of waveguide 108 to be flush with either an interior surface of the housing in a region of the slot or opening, or the edges of the slot or opening. In the latter example, the slot or opening may be sized and shaped approximately equivalently to an outward-facing opening of the waveguide.

The vertical elongation of the slot or opening 110 (e.g., which may have a height, in the y direction, that is greater than a width, in the x direction) may control vertical expansion of sound waves. The short, horizontal span of the slot may provide minimal to no control over horizontal expansion of the sound waves. When having this rectangular shape, the slot or opening 110 may be referred to as a diffraction slot. The ratio of the vertical (e.g., y direction, or height) to horizontal (e.g., x direction, or width) dimensions of the slot or opening 110 may be any ratio that is greater than 1, such as 2:1, 7:1, 31:1, etc. The external surface of the housing in the vicinity of the slot or opening 110 may be shaped to further control the expansion of sound waves exiting the waveguide 108. For example, a mouth 112 may be formed by a portion of the front surface of the housing 102, which curves forward (e.g., in the z direction) and outward (e.g., in opposing x directions from opposing sides of the opening 110) from the opening and toward the grill 105*a* and 105*b* of the woofers 104*a* and 104*b*, respectively. The outward expansion of the mouth 112 may provide control over the horizontal and/or vertical expansion of the sound waves exiting the waveguide 108.

The loudspeaker system 100 illustrated in FIGS. 1A and 1B provides just one example configuration of loudspeaker components in a housing. For example, the waveguide 108 may be included in a loudspeaker system with a different number, type, and/or arrangement of loudspeakers. The waveguide 108 may additionally or alternatively be used to propagate sound waves from a different type of loudspeaker (e.g., a loudspeaker configured to output sound at a different range of frequencies than compression driver 106). As will be discussed in more detail below, the waveguide 108 and associated loudspeaker may be one of a plurality (e.g., an array) of similar or equivalent waveguides and associated loudspeakers in example loudspeaker systems.

Figure 2:
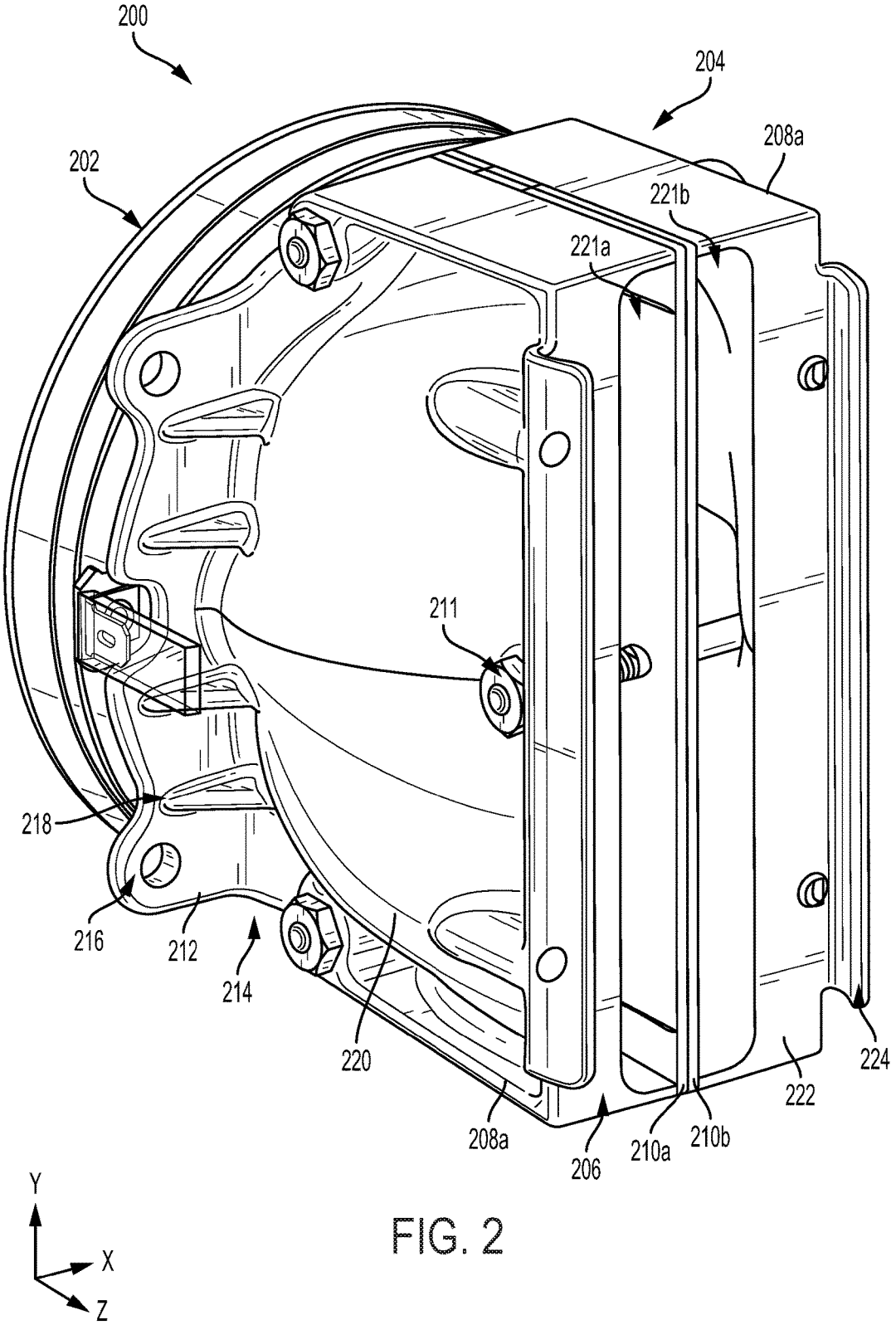
FIG. 2 shows a projection view of an example loudspeaker including a waveguide in accordance with one or more embodiments of the present disclosure.

FIG. 2 shows a projection view of an example loudspeaker 200, including a driver unit 202 and a waveguide 204. Loudspeaker 200 may be an example of high frequency loudspeaker/compression driver 106 of FIGS. 1A and 1B, and waveguide 204 may be an example of waveguide 108 of FIGS. 1A and 1B. The driver unit 202 may be a compressor driver and/or other sound source that generates and propagates sound waves toward the waveguide 204 responsive to electrical signal inputs provided to the driver unit. For example, the driver unit 202 may convert received electrical signals into acoustic energy through a sound-producing element, such as a fast-moving diaphragm. The acoustic energy may force the air mass within a region (such as a throat connecting the driver unit to the waveguide) toward the waveguide 204. Pressure variations within the throat or other intermediary region may force the air mass to speed up and gain kinetic energy as the air mass passes through restrictions or other structural features of the throat. As the air mass moves into and through the waveguide 204, the air mass may progressively expand as sound waves according to the contours of interior surfaces of the waveguide. Eventually, these sound waves may reach a listener, who may perceive the sound waves as audible sound.

The internal cross-sectional area of the waveguide 204 may generally increase in the z direction from the driver unit 202 to an outlet region 206 of the waveguide 204. The waveguide 204 may include two outer shells 208*a* and 208*b* and two inner shells 210*a* and 210*b* that, when fit together as illustrated in FIG. 2, provide substantially complementary sets of pathways for air to travel from the driver unit to the outlet region. For example, the sets of pathways created between the first outer shell 208*a* and the first inner shell 210*a* may be similarly or substantially equivalently sized and shaped to the sets of pathways created between the second outer shell 208*b* and the second inner shell 210*b*. More detail regarding the pathways will be provided below, with respect to FIGS. 3-8. The shells of the waveguide may be coupled together via a suitable coupling mechanism or combinations of coupling mechanisms, such as screws, bolts, welding, adhesion, etc. In the illustrated example, a plurality of threaded bolts 211 are used to couple the waveguide shells, where each bolt passes through all of the shells (e.g., passes from the first outer shell 208*a*, through the inner shells 210*a/b*, and to the second outer shell 208*b*).

The waveguide 204 may be coupled to the driver unit 202 via an inlet-side flange 212 positioned at an inlet region 214 of the waveguide. The inlet-side flange 212 may be formed by the joined outer and/or inner shells 208*a*-210*b*. The inlet-side flange 212 may provide a flush surface to which the driver unit may be mounted or otherwise coupled in order to produce a substantially air-tight seal between the driver unit and the waveguide. Accordingly, the inlet-side flange 212 may have a larger diameter and/or circumference than at least the portion of the driver unit 202 that is coupled to the waveguide 204. The inlet-side flange 212 may also have a shape that is complementary to an output region of the driver unit (e.g., a region of the driver unit that is coupled to the flange), such as a generally circular, curved, and/or round shape. The perimeter region of the flange may not be coupled to the driver unit 202, and may be either open or coupled to another component of an associated loudspeaker system (e.g., an internal feature of a housing of the loudspeaker system. For example, the inlet-side flange 212 may include one or more protrusions 216 that extend from points along the perimeter of the flange. The protrusions 216 may be solid or include holes, as illustrated, which may be used to couple to the flange to an additional component(s). The flange may also provide structural support for other portions of the waveguide in order to provide rigidity for the waveguide. For example, one or more structural supports 218 may extend from an outer surface 220 of the first outer shell 208*a* to a peripheral region of the inlet-side flange 212 (e.g., a peripheral region of a waveguide-facing surface of the inlet-side flange, opposite a driver-facing surface of the inlet-side flange).

The waveguide 204 may be coupled to a loudspeaker housing or other component of a loudspeaker system via an outlet-side flange 222. The outlet-side flange 222 may be positioned opposite the inlet-side flange 212, at the outlet region 206 of the waveguide, and may be formed by the joining of the outer and/or inner shells 208*a*-210*b*. The outlet-side flange 222 may be generally rectangular in shape and/or otherwise complementary to the shape of the outlet region 206 (e.g., the openings 221*a* and 221*b* for the sound pathways formed between complementary inner and outer shells). The outlet-side flange 222 may include one or more (e.g., two, in the illustrated example) protrusions 224 extending from sides of the generally rectangular perimeter of the flange. The illustrated protrusions 224 are curved and generally rectangular, extending first from a side of the flange, then curving to extend outward away from the outlet region 206 (e.g., in a substantially positive z-direction), and then curving slightly in an x-direction to create a slight hook shape. The protrusions 224 may thus provide a hook or notch for coupling to a complementary lip within a housing or other loudspeaker structure. In the illustrated example, opposing protrusions are provided on opposite sides of the outlet-side flange 222. In other examples, a different number and/or shape of protrusions may extend from the outlet-side flange in order to couple to complementary surfaces of components of a loudspeaker system.

Figure 3:
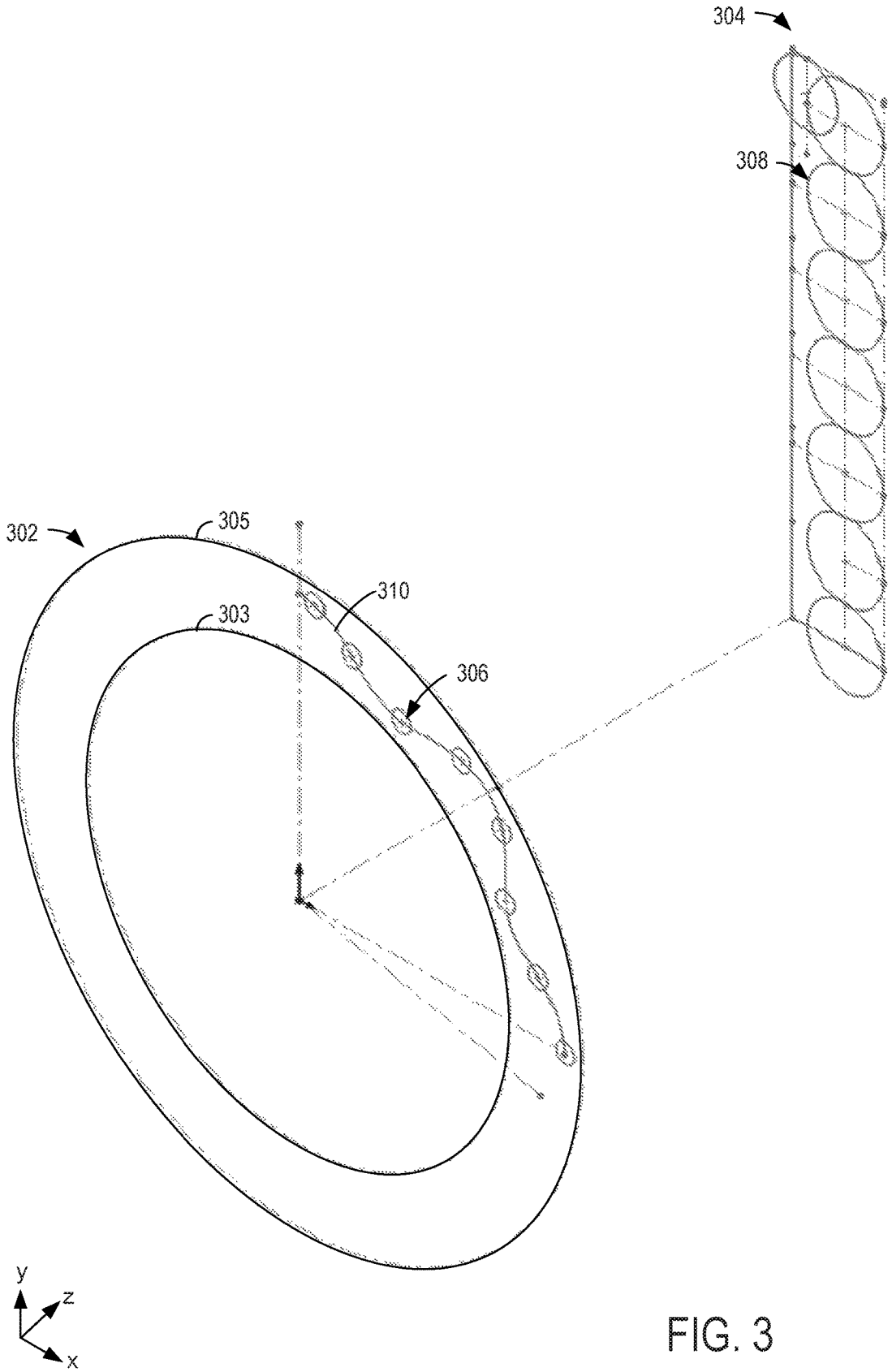
FIGS. 3-8 show an example derivation of an air pocket for use in configuring a waveguide in accordance with one or more embodiments of the present disclosure.

As discussed above, a waveguide that creates acoustic paths of substantially equal length in three-dimensional space provides increased control over a shape of sound output relative to waveguides that include acoustic paths that are only equal length in one two-dimensional surface (e.g., plane). FIGS. 3-6 illustrate an example derivation of an air pocket for use in configuring a waveguide that provides the above-described paths with equal length in multiple planes. FIG. 3 shows a representation of an inlet region 302 of a waveguide and an outlet region 304 of a waveguide. For example, the inlet region 302 may correspond to an opening (or a portion of an opening) at the inlet region 214 of the waveguide 204 of FIG. 2 (e.g., the generally circular opening of the inlet region) and outlet region 304 may correspond to an opening (or a portion of an opening, such as a portion of opening 221*a*) at the outlet region 206 of the waveguide 204 of FIG. 2 (e.g., the generally rectangular opening of the outlet region). As shown, the inlet region 302 includes an inner circumference or perimeter 303 and an outer circumference or perimeter 305, between which sound may enter an associated waveguide.

The illustrated inlet circular sections 306 may be virtual points representing discrete points of entry of the overall sound path (e.g., from a driver unit) directed to the waveguide. The illustrated outlet circular sections 308 may be virtual points representing discrete points of exit of the overall sound path directed out of the waveguide. Accordingly, the virtual points on the inlet side of the waveguide may be located in a plane that is coplanar with an end or inlet-facing surface of the waveguide (e.g., flange surfaces of the waveguide shells). For illustrative purposes, points of entry of the sound path are only provided for a quarter section of the inlet of the waveguide, and corresponding points of exit of the sound path are thus provided for a quarter section of the outlet of the waveguide. For example, the outlet region 304 may correspond to an upper half of the opening 221*a* (or to another half of either opening 221*a* or 221*b*) of FIG. 2. It is to be understood that similarly-configured sound paths and associated inlets and outlets may be provided for the remaining three quarters of the inlet region 302 and the outlet region 304. For example, the sound paths for the illustrated quarter of the inlet region 302 may be repeated along each of the remaining three quarters of the inlet region (e.g., around the periphery of the inlet region) and directed to additional portions of the outlet region (e.g., to extend the outlet region to appear similar to the openings 221*a* and 221*b* of FIG. 2).

The inlet circular sections 306 are illustrated as being distributed along an approximate sine wave curve 310 in the inlet region 302 (e.g., in a sinusoidal plane that is perpendicular to the sine wave curve 310 and/or a center of the sinusoidal curve formed at the inlet opening of the waveguide). When repeated in the remaining three quarters of the inlet region, the resulting curve may be a sine wave ring. The sine wave curve may be regular (e.g., where each peak-to-trough distance of the sine wave curve is substantially equal to one another, such that the distance between the inner circumference 303 and points of entry that are closest to the inner circumference is substantially equal to the distance between the outer circumference 305 and points of entry that are closest to the outer circumference 305). In other examples, the sine wave curve may be irregular (e.g., where peak-to-trough distances vary along the curve). In still other examples, the inlet geometry (e.g., the distribution of the inlet circular sections 306) may form a circular ring (e.g., substantially following the outer and/or inner circumference of the illustrated example inlet region 302, such that the distances between the inner and/or outer circumference and each point of entry to the inlet are substantially equal). The outlet geometry may be configured as a vertical slot, where most or all of the outlet circular sections 308 are stacked on top of one another in a vertical direction (e.g., adjacent to and in contact with one another in the illustrated example), and a vertical dimension is larger than a horizontal dimension (e.g., between 6 and 8 times larger).

Figure 4:
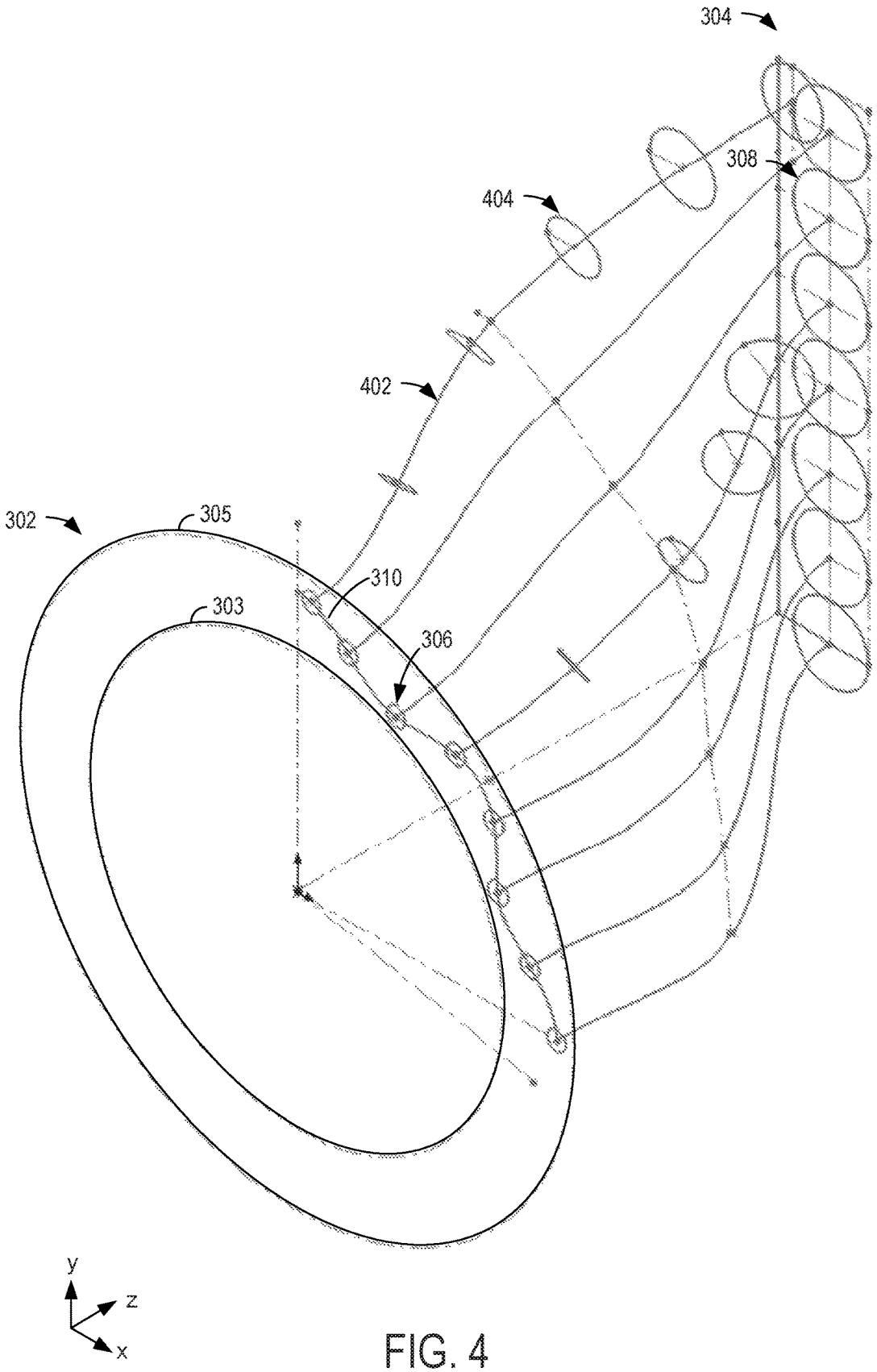

FIG. 4 shows another stage of configuration, in which three-dimensional splines 402 of equal (or substantially equal, such as within 5%) length are placed between centers of corresponding inlet and outlet circular sections 306 and 308. Additional circular sections 404 may be placed on normal planes distributed along the splines, the diameters of which are controlled by a curve representing a selected rate of expansion. In this way, the waveguide may be configured to accommodate a rate of expansion that is suitable for a given environment to produce a desired sound output shape, including a linear rate of expansion, an exponential rate of expansion, and/or any other rate of expansion that can be plotted on an X/Y plot.

Figure 5:
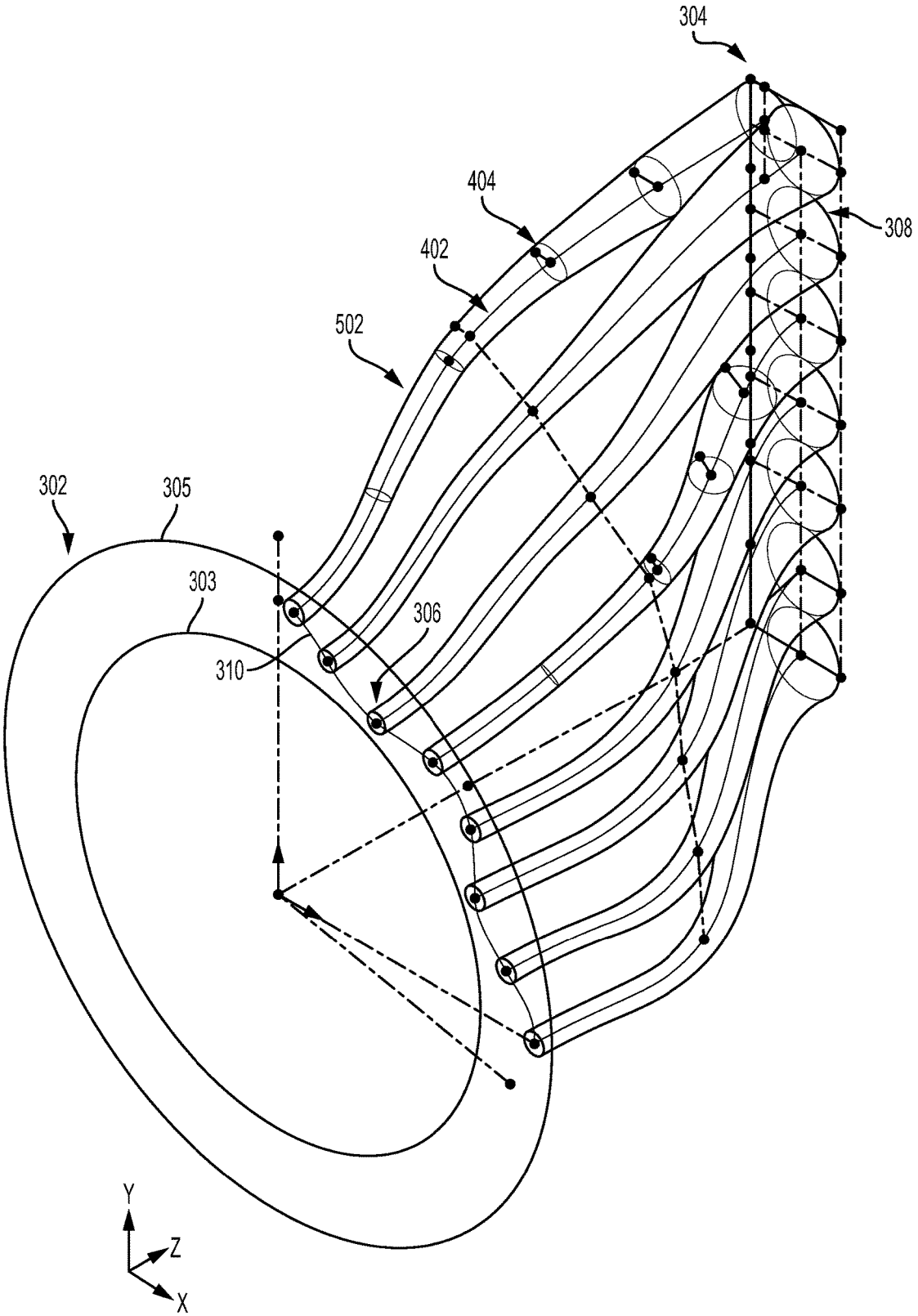

In a computer modeling program, each circular section of a given path from inlet circular section to outlet circular section may be lofted (e.g., coupled via transitions along the splines 402) to an adjacent circular section in the direction from inlet to outlet, as shown in FIG. 5. In this way, conic lofts 502 may be formed along each path from a given inlet circular section to an associated outlet circular section.

Figure 6:
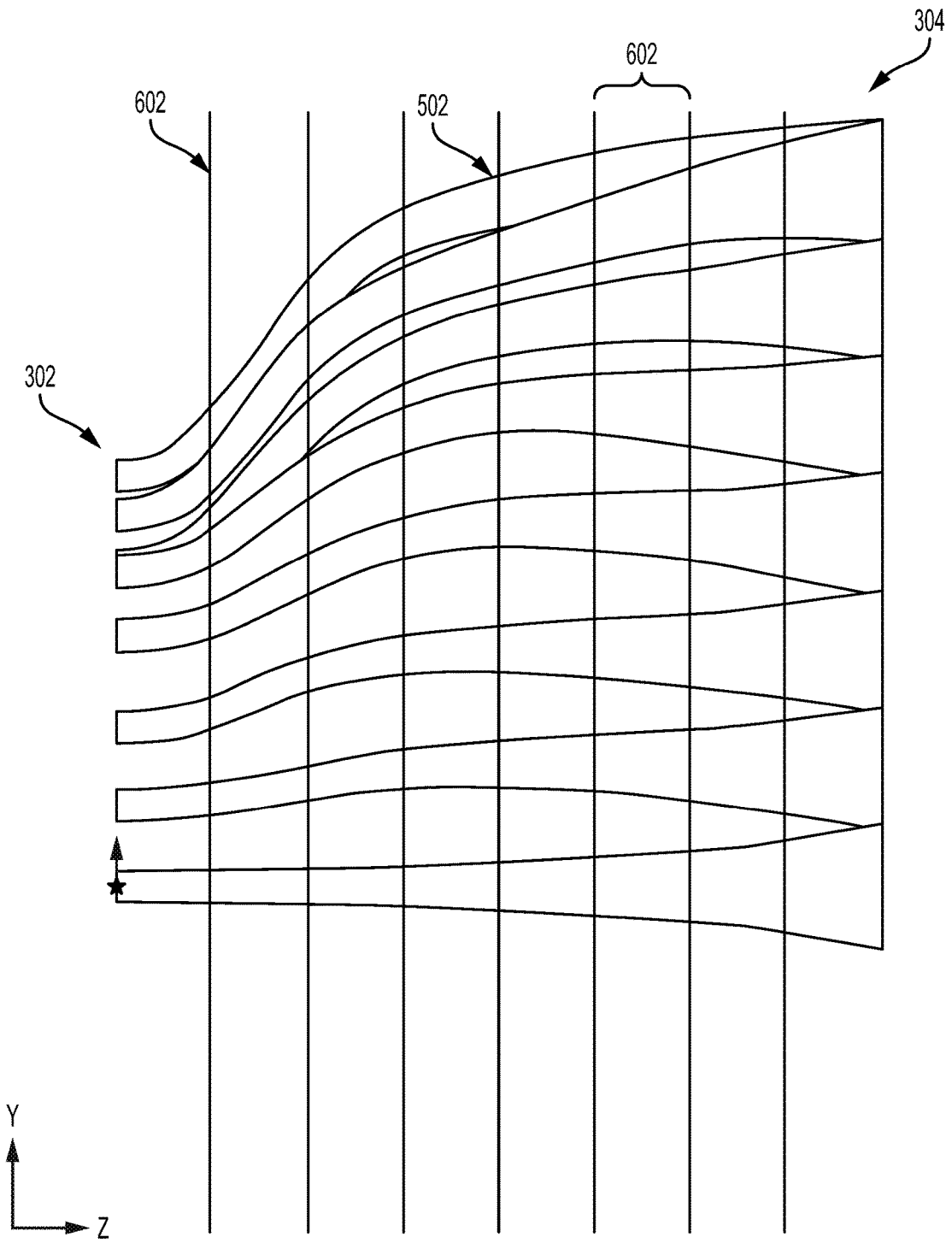
Figure 7:
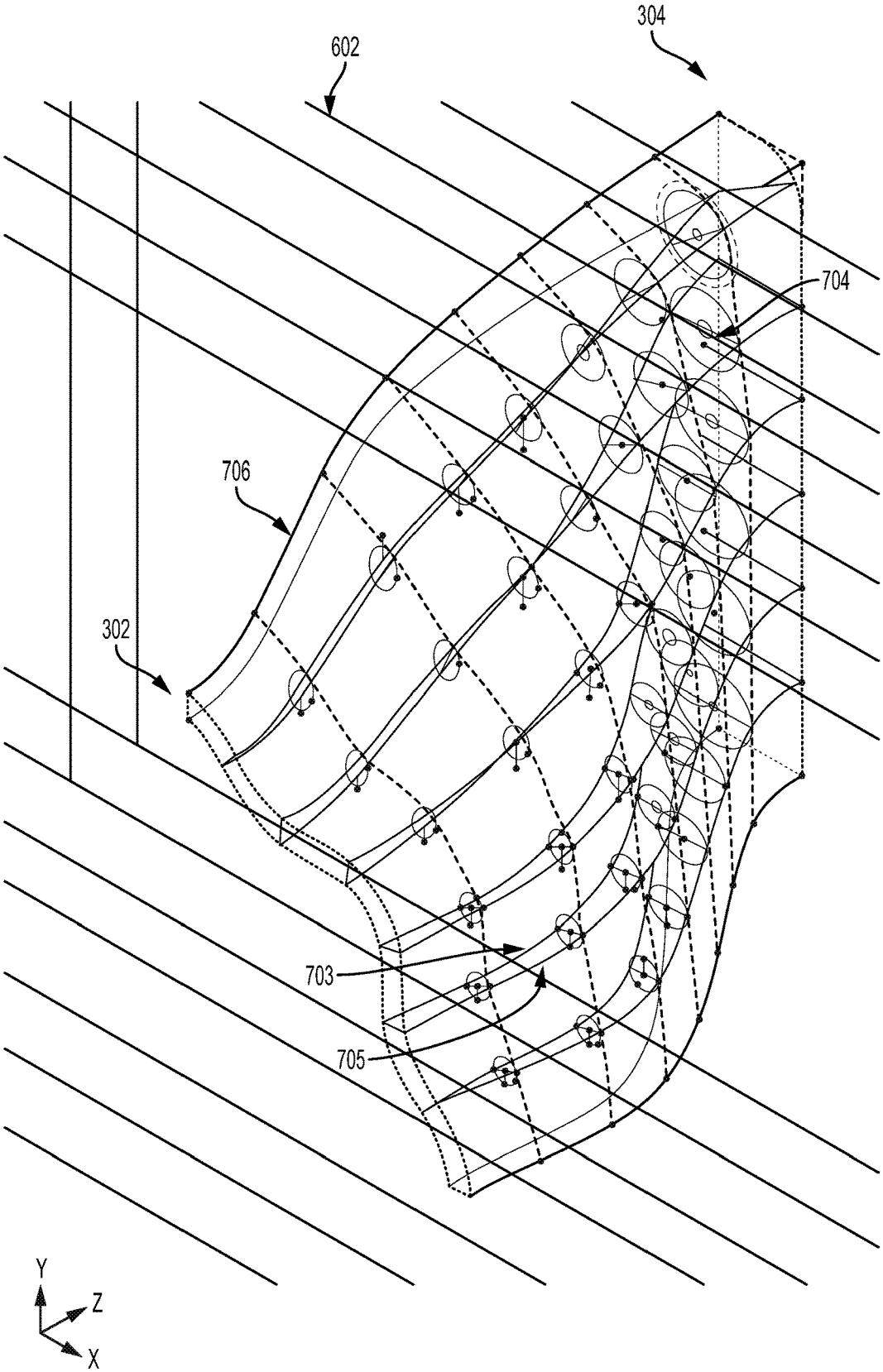

As shown in FIGS. 6 and 7, cross section planes 602 (e.g., parallel in the z-axis) may be created, equally distributed along the z-axis (e.g., the axis directing from inlet region 302 to outlet region 304) of the representation. Conic sections 602 may be created by intersecting the conic lofts 502 with the parallel cross section planes 602. As shown in FIG. 7, inner/outer circumferential splines 703/705 that are tangent to the conic sections may be constructed. Accordingly, rulings (e.g., median lines 704) that project perpendicularly from the inner circumferential spline 703 through the center spline (e.g., spline 402 of FIG. 4) and to the outer circumferential spline 705 may be constructed.

Figure 8:
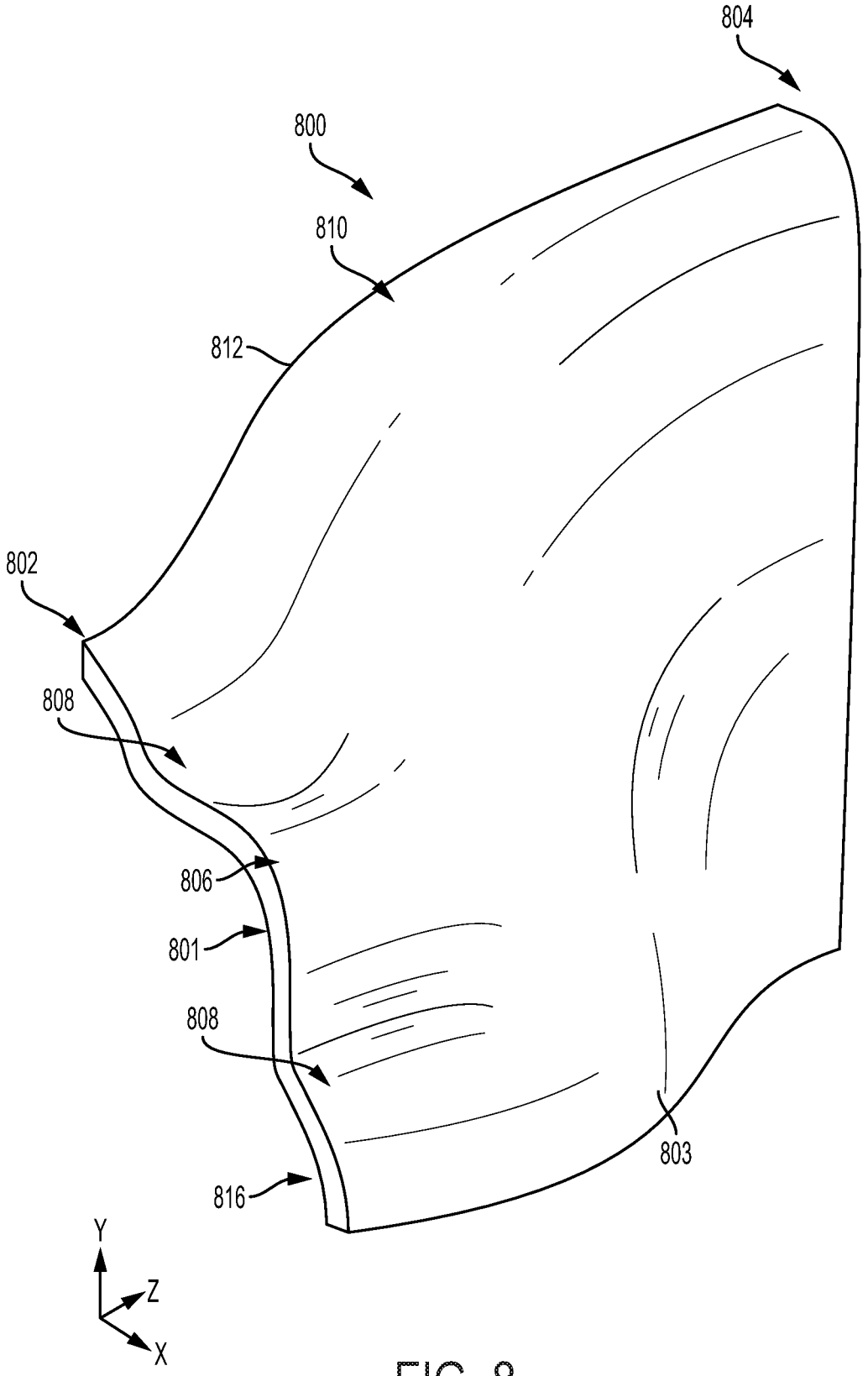

The rulings or median lines 704 may be lofted together into a complex, ruled surface 706, which creates longitudinal splines/edges. As shown in FIG. 8, the edges of the median surfaces may be used together with the inlet and outlet circular sections in a new loft to create the air space 800 of the waveguide. The final surfaces (e.g., inner surface 801 and outer surface 803) may then be defined by the mesh composed of the longitudinal and circumferential splines. The air space 800 represents the gap formed between complementary shells of a waveguide, which may guide sound waves emitted from a driver unit coupled to the waveguide. For example, air space 800 may represent the shape of one half of the air gap between an opening of inlet region 214 of waveguide 204 and the opening 221*a* of outlet region 206 of waveguide 204 (between outer shell 208*a* and inner shell 210*a*) of FIG. 2. As illustrated, the inlet region 802 of the air space 800 follows the curve of the inlet region 302 of FIG. 3 and the outlet region 804 of the air space 800 forms the shape of the outlet region 304 of FIG. 3. Accordingly, near the inlet region 802, the air space 800 includes a middle protrusion 806 corresponding to a peak of a sinusoidal wave, and two depressions 808 corresponding to troughs of the sinusoidal wave that the inlet region follows. With respect to a length of the air space 800 from the inlet region to the outlet region, the middle portion 810 of the air space generally protrudes relative to the inlet region. In the middle portion 810, the protrusions and depressions of the inlet region 802 curve upward (e.g., to a first edge 812 of the air space 800) in a stretched "S" shape, where an inclination toward the first edge 812 is greatest in the middle portion 810 of the air space. The protrusions and depressions of the inlet region 802 are smoothed toward the outlet region 804, to form the generally rectangular shape of the outlet region.

In order to provide the air space 800 in a wave guide, an outer shell is formed to follow the curvature of the outer surface 803 of the air space 800, and an inner shell is formed to follow the curvature of the inner surface 816 of the air space 800. Joining the outer shell to the inner shell will thus create an air gap having the properties of the air space 800. For example, the air space 800 may form a half of the air gap introduced between outer shell 208*a* and inner shell 210*a* of FIG. 2. Accordingly, half of the inner surface of outer shell 208*a* of FIG. 2 may follow the curvature of the outer surface 803 of air space 800. Half of the outer surface of inner shell 210*a* of FIG. 2 may follow the curvature of the inner surface 816 of air space 800. The remaining halves of the inner and outer shell surfaces may also follow the curvature of the air space 800 in a complementary manner. Accordingly, the description of these surfaces of the shells may also describe the surfaces of the air space 800.

Figure 9:
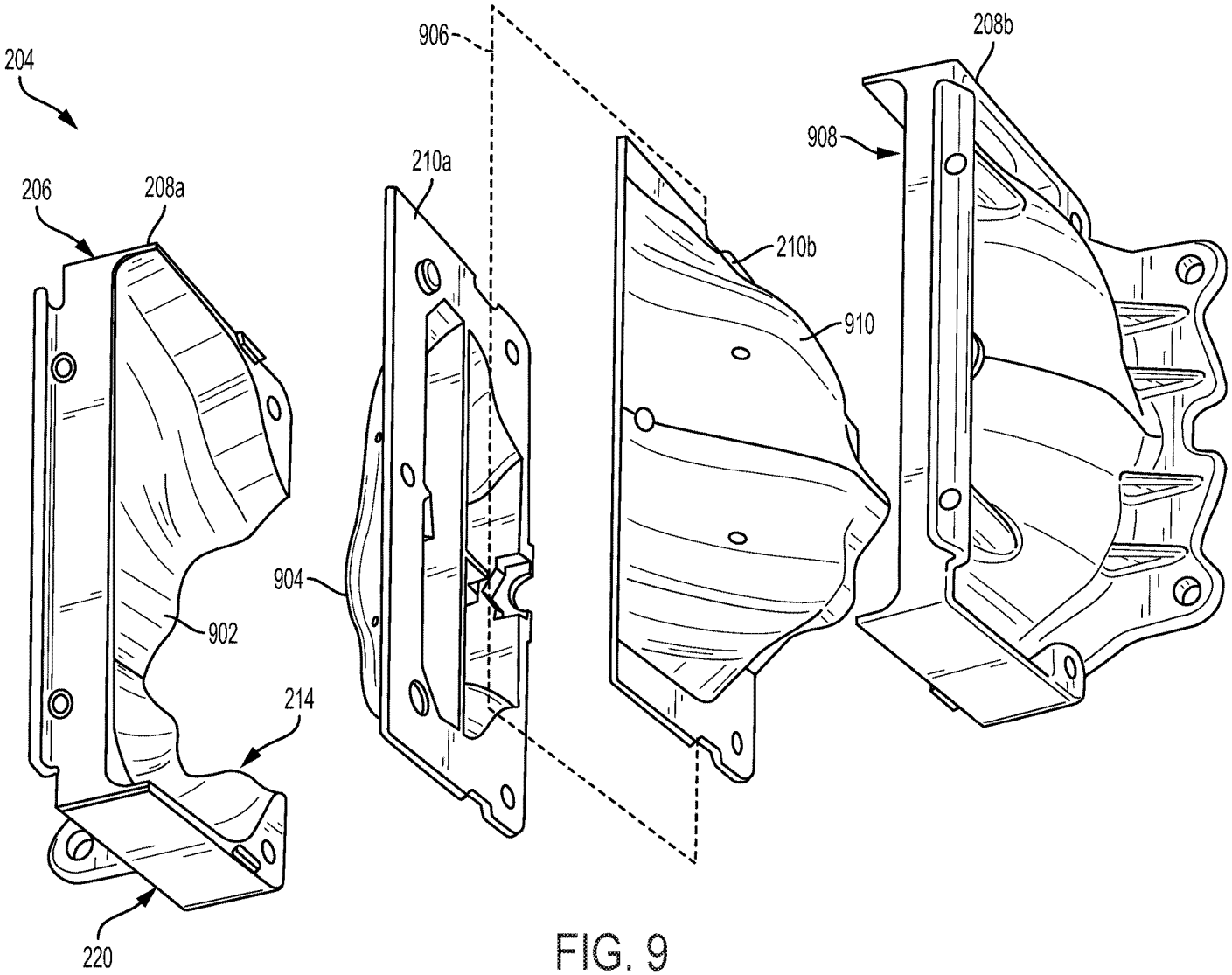
FIG. 9 shows an exploded view of shells of the waveguide of FIG. 2 from an outlet side in accordance with one or more embodiments of the present disclosure.

Turning now to FIG. 9, an exploded view of the shells of waveguide 204 of FIG. 2 is shown including an outlet side (e.g., in outlet region 206) of the shells. As shown, an interior surface 902 of outer shell 208*a* generally protrudes outward away from an exterior surface 904 of inner shell 210*a*. Since outer and inner shells 208*b* and 210*b* are substantially duplicates to outer and inner shells 208*a* and 210*b* (the waveguide is symmetric with respect to a central plane 906 disposed between the inner shells), an interior surface 908 of outer shell 208*b* generally protrudes outward away from an exterior surface 910 of inner shell 210*b*. It is to be understood that descriptions of the outer and inner shells 208*a* and 210*a* similarly apply to outer and inner shells 208*b* and 210*b*, respectfully. Likewise, the descriptions of outer and inner shells 208*b* and 210*b* similarly apply to outer and inner shells 208*a* and 210*a*, respectively. Accordingly, descriptions will be provided in the present disclosure for a given shell based on the views available in an associated figure, but will be understood to apply to the other shell of that type (e.g., inner or outer).

The shape of the interior surface 902 and the exterior surface 904 of the outer and inner shells, respectively, are continuous, smooth, undulating surfaces that provide an uninterrupted pathway (e.g., without obstruction) along the surface from the inlet region 214 to the outlet region 206 (e.g., from the sinusoidal curve of the inlet region to the rectangular exit of the outlet region). The interior surface 902 and the exterior surface 904 may not have any edges or corners. For example, the interior surface 902 and the exterior surface 904 may continuous and uninterrupted until the respective surface meets another surface, such as at a planar flange as described below, at a peripheral region.

Figure 10:
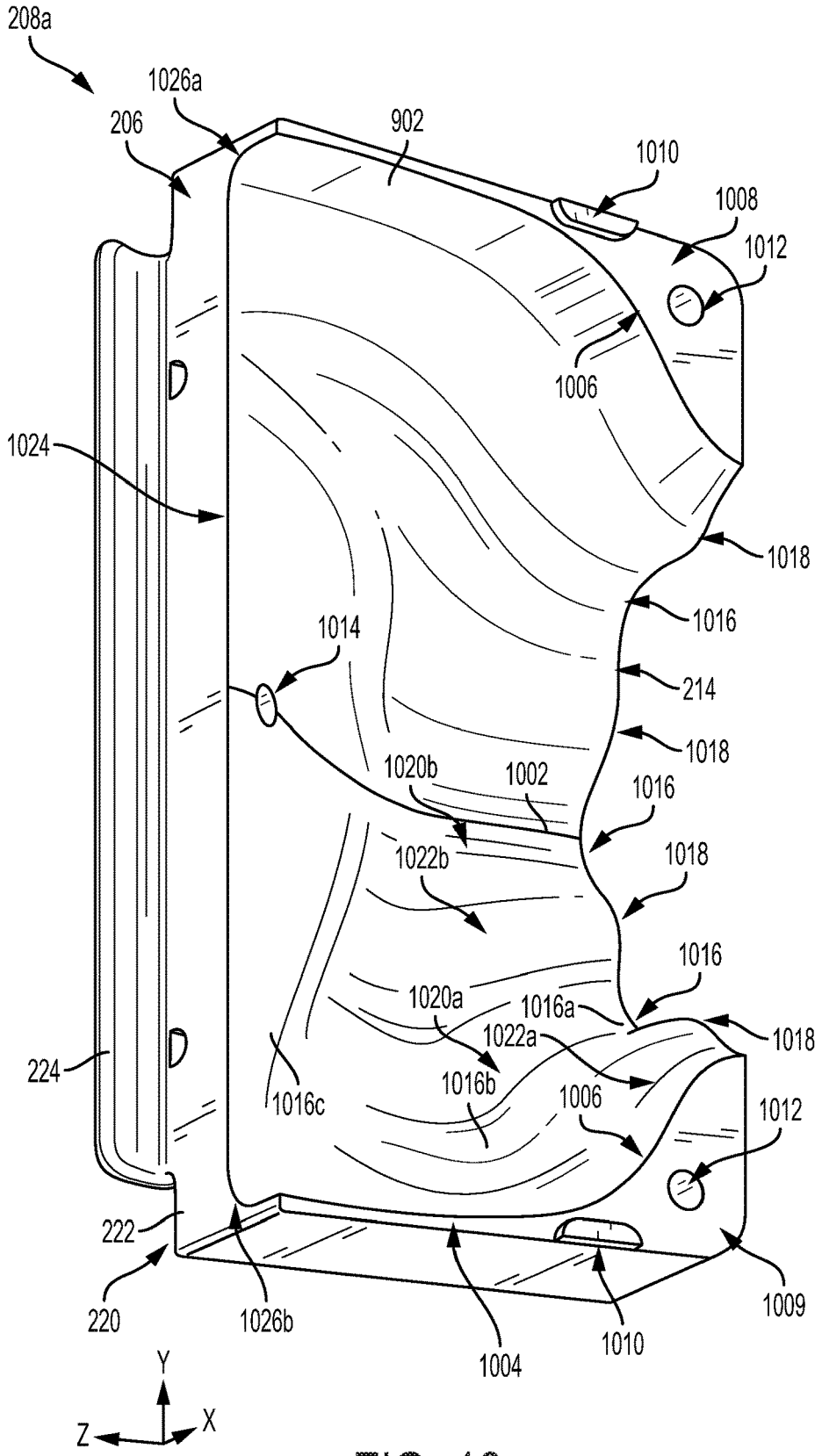
FIG. 10 shows an isolated view of an outer shell of the waveguide of FIG. 2 in accordance with one or more embodiments of the present disclosure.

FIG. 10 shows an isolated view of outer shell 208*a*. Seam 1002 may represent a halfway point of a vertical (e.g., y) dimension of the shell. Accordingly, regions of the interior surface 902 of the outer shell 208*a* above the seam may follow the curvature of an outer surface of the air space 800 of FIG. 8 in some examples. Likewise, regions of the interior surface 902 of the outer shell 208*a* below the seam may also follow the curvature of the outer surface of the air space 800 of FIG. 8, such that the outer shell is symmetric (or at least the interior surface 902 of the outer shell is symmetric) with respect to the seam 1002.

The interior surface 902 curves outward from the inlet region 214 toward the outlet region 206 to allow for vertical expansion of sound waves traveling along the surface. The curvature of the interior surface 902 in the y-direction changes more rapidly in the inlet region 214 than in the outlet region 206. For example, the height of the interior surface (in the y-direction) may increase rapidly from the inlet region 214 to an approximate central region 1004 (in the z-direction) and then may stay substantially the same from the central region 1004 to the outlet region 206. Accordingly, a perimeter 1006 of the interior surface 902 may have a large slope in the y-direction from the inlet region 214 toward the central region 1004 and a small or zero slope in the y-direction from the central region 1004 toward the outlet region 206.

The outer shell 208*a* may include a flange 1008 that provides a surface for coupling the outer shell to a complementary inner shell (e.g., inner shell 210*a*) and/or other component of a loudspeaker. Flange 1008 may include coupling mechanisms such as tabs 1010, which protrude from the flange and are configured to mate with a complementary structure on an associated inner shell, and holes 1012, which are configured to mate with a complementary structure on the associated inner shell. Hole 1014 within interior surface 902 may provide a connection point for a bolt or other coupling mechanism used to hold the waveguide together.

As discussed above with respect to the air space 800, the interior surface 902 may include dimples and/or protrusions that vary the width of the outer shell in the x-direction according to an arrangement of sound pathways to be created in the gap between the outer shell and the associated inner shell. For example, the width of the outer shell from the flange 1008 to the exterior surface 220 (and/or to different regions of the interior surface 902) may vary due to the dimples and/or protrusions. The width from the surface of the flange 1008 to the interior surface 902 is lesser in regions near the perimeter 1006 of the interior surface 902 than in regions toward a center of the interior surface. Further, the width from the surface of the flange to the interior surface is greater in regions following the outward-extending curves (e.g., peaks) of the sinusoidal inlet region 214 than in regions of the inward-extending troughs of the sinusoidal inlet region 214.

For example, regions 1016 may have a greater width than regions 1018. Furthermore, regions of the interior surface 902 extending from the regions 1016 toward the outlet region 206 may generally have a greater width than regions of the interior surface 902 extending from the regions 1018 toward the outlet region 206. For example, a protrusion 1020*a* at a bottommost one of regions 1016 may begin at a peak 1016*a* of the sinusoidal inlet region 214, then curve toward the bottom of perimeter 1006 of the interior surface while extending generally in the z-direction toward the central region 1004 to midpoint 1016*b* of the protrusion 1020*a*. Thus, the protrusion 1020*a* follows a similar curve to the perimeter 1006 in the inlet-to-central region. The protrusion 1020*a* may curve slightly back toward the seam 1002 while extending from the midpoint 1016*b* to an endpoint 1016*c* (e.g., toward the outlet-side flange 222). The amount of deformation caused by the protrusion (e.g., the width from the surface of the flange 1008 to the interior surface 902 in regions of the protrusion 1020*a*) may vary along the length of the protrusion (e.g., in the general z-direction, from inlet to outlet of the waveguide), but may be consistently greater than the width from the surface of the flange 1008 to the interior surface 902 in regions adjacent to the protrusion (e.g., in regions of dimples 1022*a* and 1022*b*). A similar protrusion may be present as indicated at 1020*b*. Furthermore, the protrusions and dimples present below the seam 1002 may be repeated symmetrically above the seam 1002 as well. The interior surface may have a substantially equal width taken at all points along the y-direction at the intersection of the interior surface and the outlet-side flange 222.

The intersection of the interior surface 902 and the outlet-side flange 222 may form an opening edge or perimeter 1024. As illustrated, the opening edge or perimeter 1024 may form three sides of a rectangle that has at least one curved edge (two curved edges 1026*a* and 1026*b* in the illustrated example). Between the curved edges 1026*a/b*, the opening edge or perimeter 1024 may be substantially flat (e.g., extend substantially straight in the y-direction). A fourth remaining side of the rectangle (e.g., which forms the opening 221*a* of FIG. 2) is provided by an edge of the complementary inner shell 210*a*, described below with respect to FIG. 11.

Figure 11:
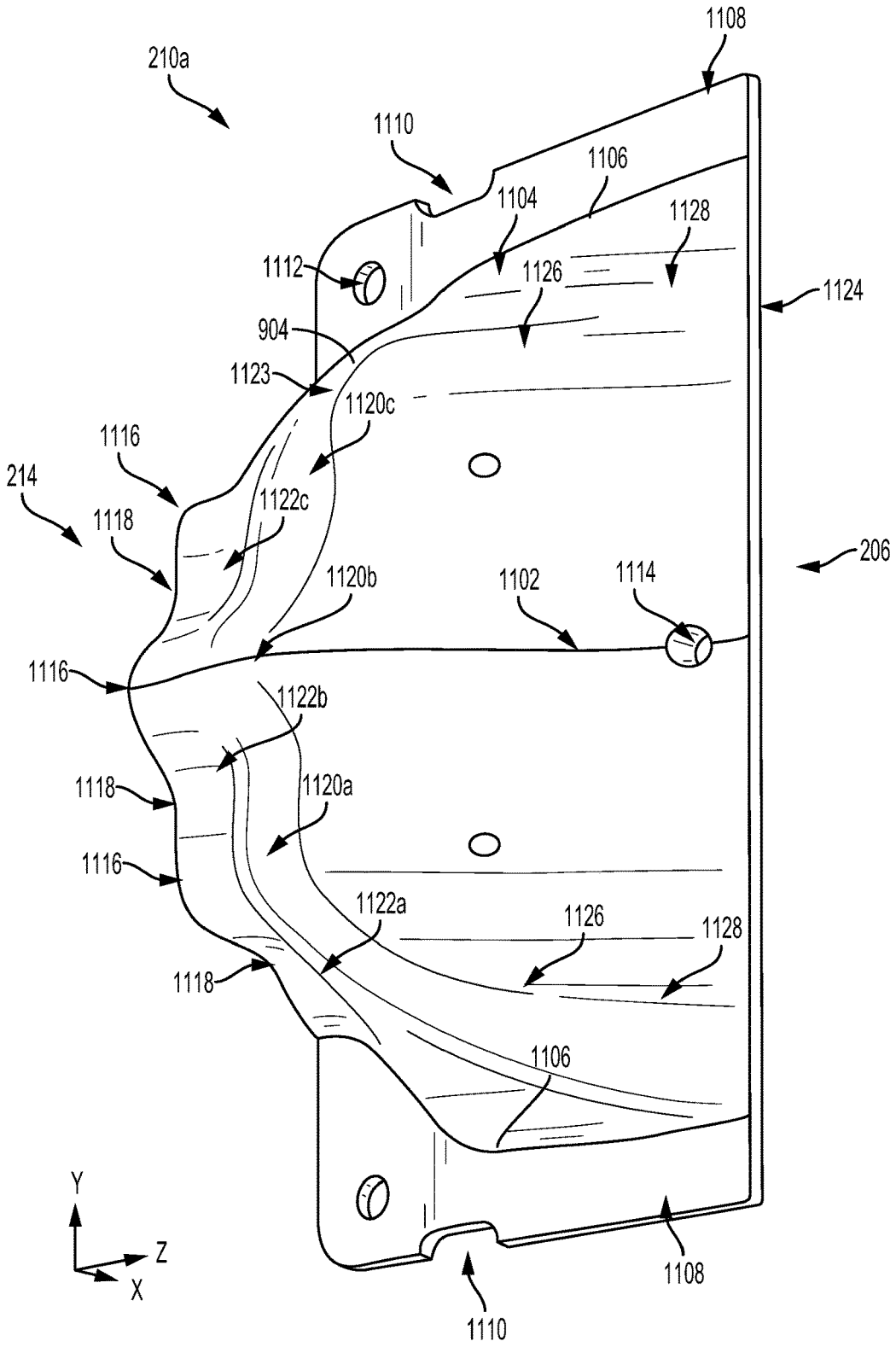
FIG. 11 shows an isolated view of an inner shell of the waveguide of FIG. 2 in accordance with one or more embodiments of the present disclosure.

FIG. 11 shows an isolated view of the inner shell 210*a*. Seam 1102 may represent a halfway point of a vertical (e.g., y) dimension of the shell. Accordingly, regions of the exterior surface 904 of the inner shell 210*a* above the seam may follow the curvature of an inner surface of the air space 800 of FIG. 8 in some examples. Likewise, regions of the exterior surface 904 of the inner shell 210*a* below the seam may also follow the curvature of the inner surface of the air space 800 of FIG. 8, such that the inner shell is symmetric (or at least the exterior surface 904 of the inner shell is symmetric) with respect to the seam 1102. The exterior surface 904 curves outward from the inlet region 214 toward the outlet region 206 to allow for vertical expansion of sound waves traveling along the surface. The curvature of the exterior surface 904 in the y-direction changes more rapidly in the inlet region 214 than in the outlet region 206. For example, the height of the exterior surface (in the y-direction) may increase rapidly from the inlet region 214 to an approximate central region 1104 (in the z-direction) and then may stay substantially the same from the central region 1104 to the outlet region 206. Accordingly, a perimeter 1106 of the exterior surface 904 may have a large slope in the y-direction from the inlet region 214 toward the central region 1104 and a small or zero slope in the y-direction from the central region 1104 toward the outlet region 206.

The inner shell 210*a* may include a flange 1108 that provides a surface for coupling the inner shell to a complementary outer shell (e.g., outer shell 208*a*), a complementary inner shell (e.g., inner shell 210*b*), and/or another component of a loudspeaker. Flange 1108 may include coupling mechanisms such as notches 1110, which cut into the flange toward the perimeter 1106 of the exterior surface and are configured to mate with a complementary structure on an associated outer and/or inner shell (e.g., tabs 1010 of FIG. 10), and holes 1112, which are configured to mate with a complementary structure on the associated outer and/or inner shell. Hole 1114 within exterior surface 904 may provide a connection point for a bolt or other coupling mechanism used to hold the waveguide together.

As discussed above with respect to the air space 800, the exterior surface 904 may include dimples and/or protrusions that vary the width of the inner shell in the x-direction according to an arrangement of sound pathways to be created in the gap between the inner shell and the associated outer shell. For example, the width of the inner shell from the surface of the flange 1108 to the exterior surface 904 in a given region may vary due to the dimples and/or protrusions. The width from the surface of the flange 1108 to the exterior surface 904 is lesser in regions near the perimeter 1106 of the exterior surface 904 than in regions toward a center of the exterior surface. Further, the width from the surface of the flange to the exterior surface is greater in regions following the outward-extending curves (e.g., peaks) of the sinusoidal inlet region 214 than in regions of the troughs of the sinusoidal inlet region 214.

For example, regions 1116 may have a greater width than regions 1118. Furthermore, regions of the exterior surface 904 extending from the regions 1116 toward the outlet region 206 may generally have a greater width than regions of the exterior surface 904 extending from the regions 1118 toward the outlet region 206. Accordingly, the protrusions 1120*a*, 1120*b*, and 1120*c* may be formed, extending from the peaks in regions 1116, while the dimples 1122*a*, 1122*b*, and 1122*c* are formed adjacent to the protrusions and extending from the troughs in regions 1118. The waveguide may have a greatest width between flange 1108 and exterior surface 904 in a region indicated at 1123, which may extend from the top region of the waveguide to the bottom region of the waveguide (e.g., in the y-direction) along a curve that generally follows the sinusoidal curve of the inlet region 214.

The exterior surface may have a substantially equal width taken at all points along the y-direction at the intersection of the exterior surface and the outlet region 206. Further, the width of the waveguide between the flange 1108 and the exterior surface 904 may generally decrease from a central region 1104 toward outlet region 206, until the width is substantially zero (e.g., the flange 1108 is flush with the exterior surface 904) at a perimeter 1124 of the inner shell 210*a*. In this way, the protrusions and dimples may smooth in the midpoint regions indicated at 1126 and flatten in the end regions indicated at 1128. The change in width from the flange 1108 to the exterior surface 904 may be greater between the region 1123 and the regions 1126 than between the regions 1126 and the regions 1128. The perimeter 1124 may form a remaining fourth side of the rectangle of the outlet opening (e.g., as discussed above with respect to FIG. 10) when the inner shell is coupled to an associated outer shell (e.g., outer shell 208*a* of FIG. 10).

Figure 12:
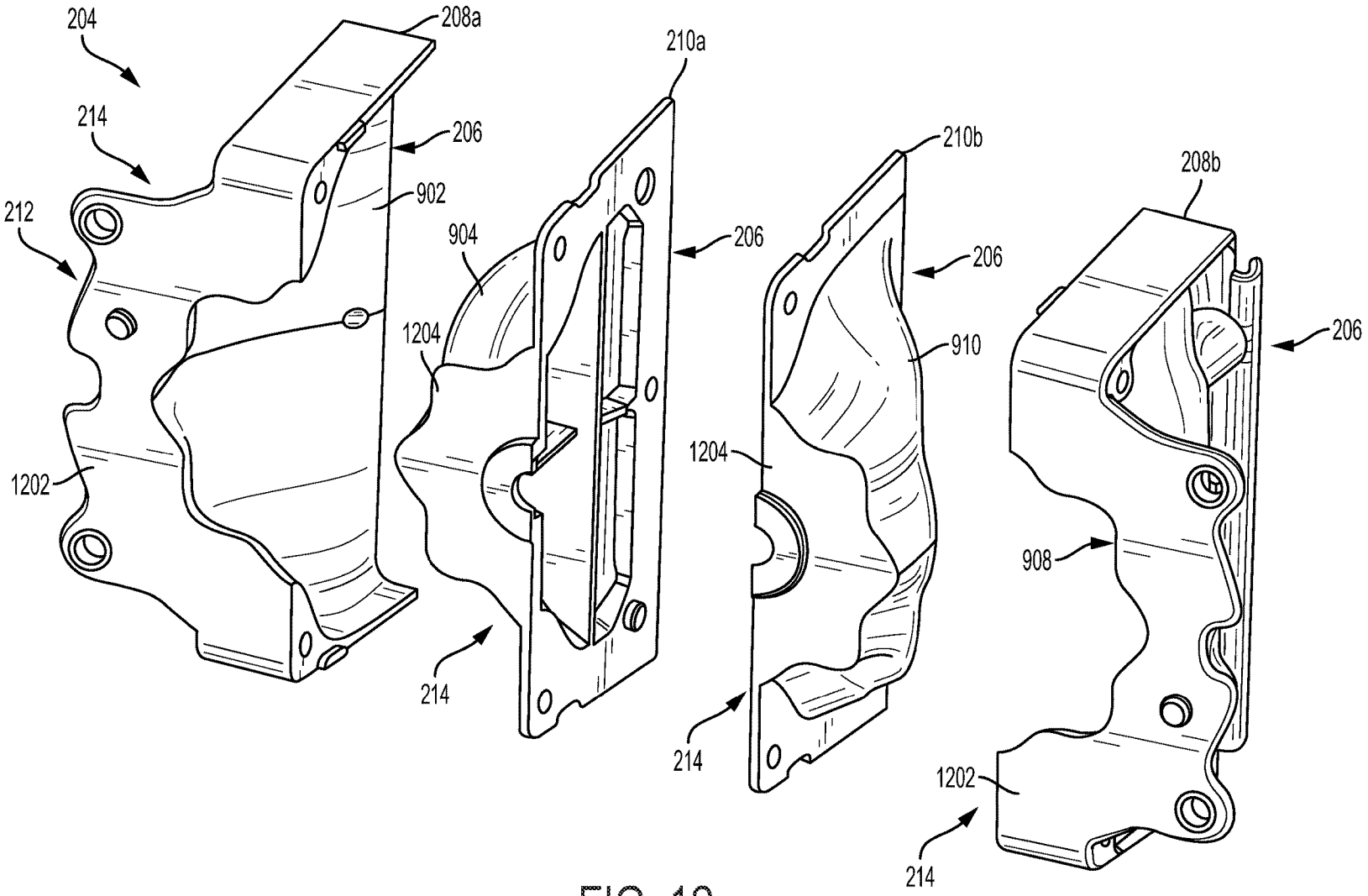
FIG. 12 shows an exploded view of shells of the waveguide of FIG. 2 from an inlet side in accordance with one or more embodiments of the present disclosure.

FIG. 12 shows an exploded view of the waveguide 204 of FIG. 2 including an inlet region 214 of the waveguide shells. As shown, the peaks and troughs at an inlet region of the inner shells 210*a* and 210*b* may be complementary to the peaks and troughs at the inlet region of the outer shells 208*a* and 208*b*, respectively. As further shown, the inlet flange 212 of FIG. 2 may have an outer shell portion and an inner shell portion. For example, outer shell 208*a* may include an outer flange portion 1202 and inner shell 210*a* may include an inner flange portion 1204. Each flange portion may include substantially planar surfaces for coupling to a drive unit or other sound-producing source. Outer and inner shells 208*b* and 210*b* may similarly include flange portions that together form the flange 212.

Figure 13:
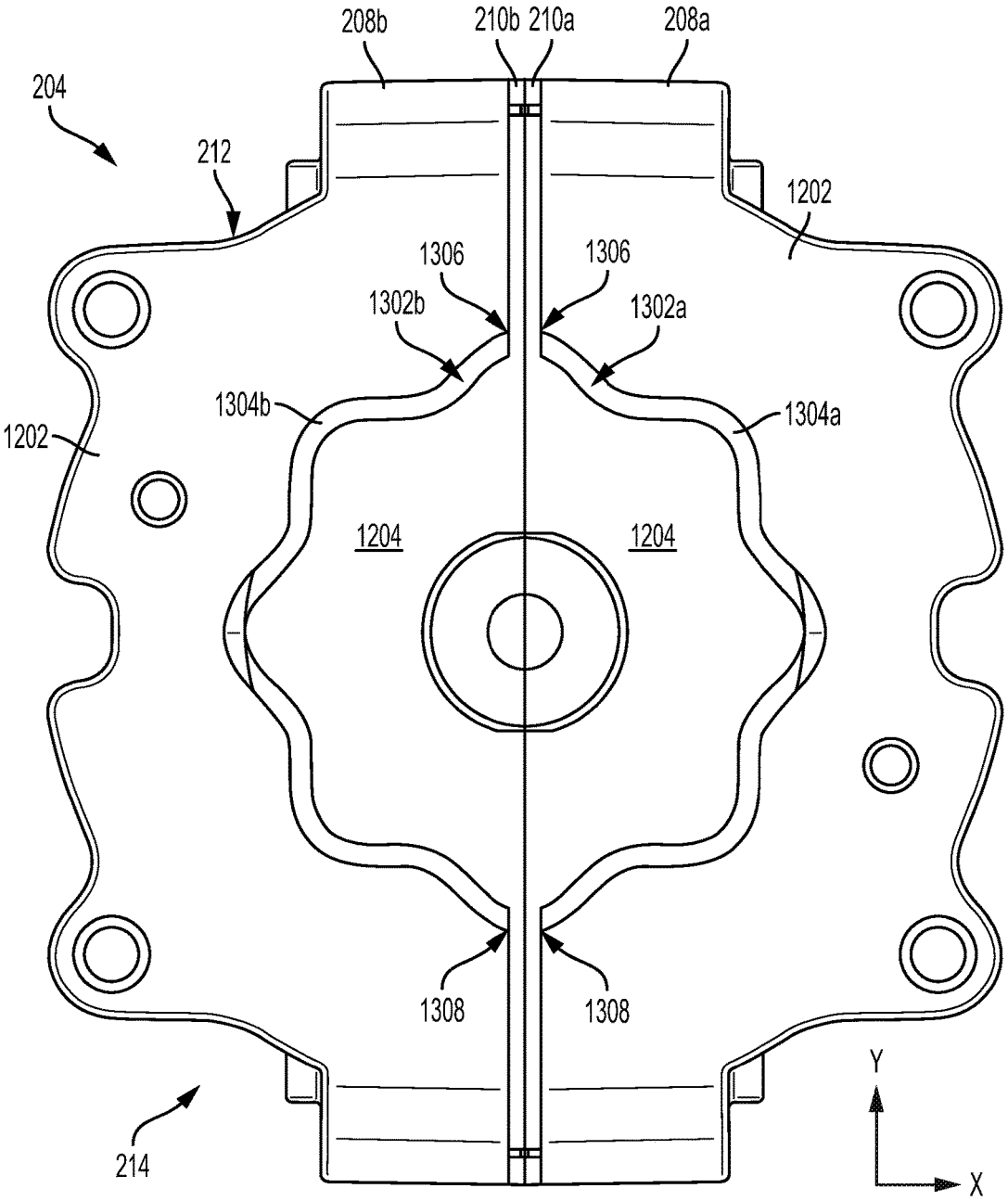
FIG. 13 shows the waveguide of FIG. 12 joined together in accordance with one or more embodiments of the present disclosure.

FIG. 13 shows the waveguide 204 of FIG. 12 joined together to create sound paths 1302*a* and 1302*b* for sound to travel from a driver unit into the waveguide at an inlet region 214. As illustrated, each sound path inlet 1304*a* and 1304*b* is formed by edges or perimeters of the inlet-side flange portions 1202 and 1204. Accordingly, the sound path inlets 1304*a* and 1304*b* may each form a continuous semi-circular curve that follows the substantially sinusoidal curvature of the inlet regions of the shells. When joined as shown in FIG. 13, the sound path inlets may form a continuous undulating ring (e.g., extending around an annulus of the opening at the inlet) that is only interrupted at a top and a bottom of the ring by the inlet surfaces of the inner shells. Each sound path inlet may have a top termination point 1306 and a bottom termination point 1308 defined by the intersection between complimentary outer and inner shells. Along the undulating path of the sound path inlets 1304*a* and 1304*b* (e.g., around the ring formed by the sound path inlets), the sound path inlets may have a substantially equal width (e.g., distance between the edge of the outer shell portion 1202 and the edge of the inner shell portion 1204 at a given location around the inlet curve).

Figure 15:
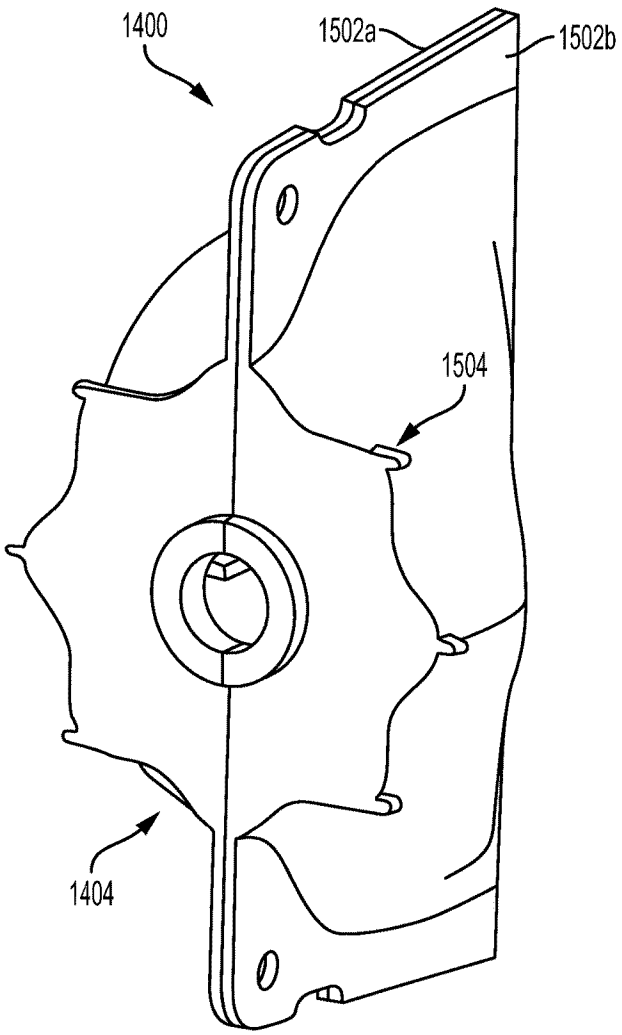
FIGS. 14 and 15 show an additional or alternate example waveguide construction in accordance with one or more embodiments of the present disclosure.
Figure 14:
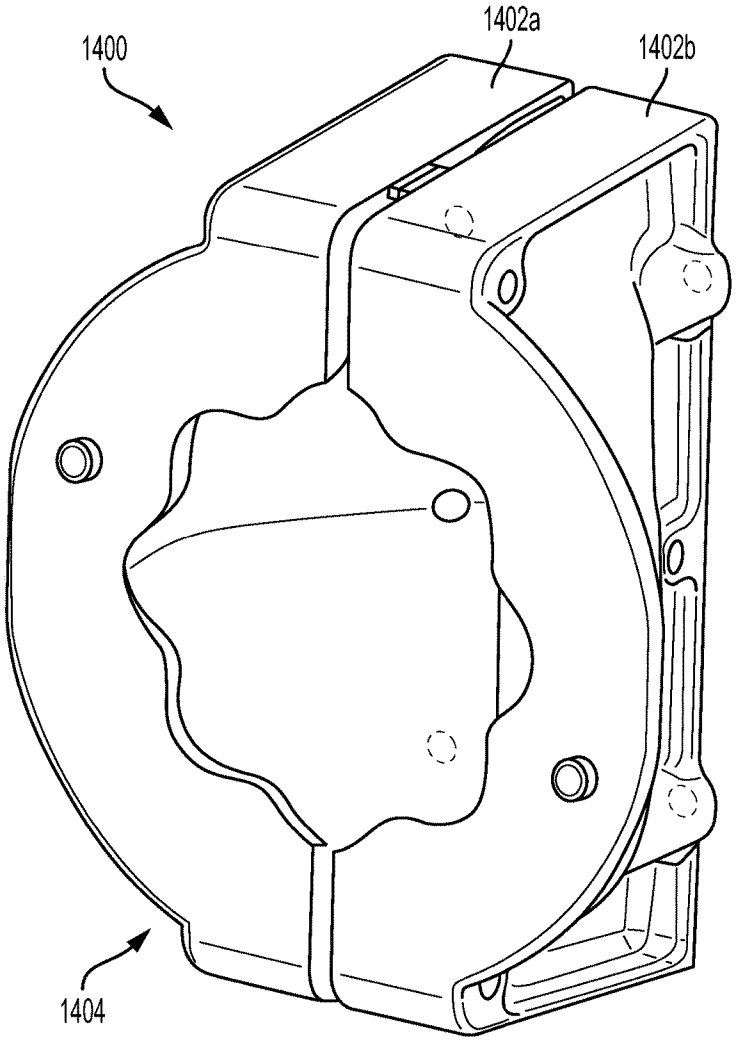

FIGS. 14 and 15 show an additional or alternate example waveguide 1400 including outer shells 1402*a* and 1402*b* joined together (FIG. 14) and inner shells 1502*a* and 1502*b* joined together (FIG. 15). The waveguide 1400 may be similar to waveguide 204 of FIGS. 2 and 9-13 in some examples. For example, waveguide 1400 may have an inlet region 1404 that is similar to inlet region 214 of waveguide 204 of FIG. 2. However, in the example shown in FIG. 15, the inlet region 1404 of the inner shells may include protrusions 1504 at peaks of the sinusoidal curve at the inlet region. The protrusions 1504 may be used to couple the inner shells to associated outer shells 1402*a* and 1402*b*, respectively.

Figure 16:
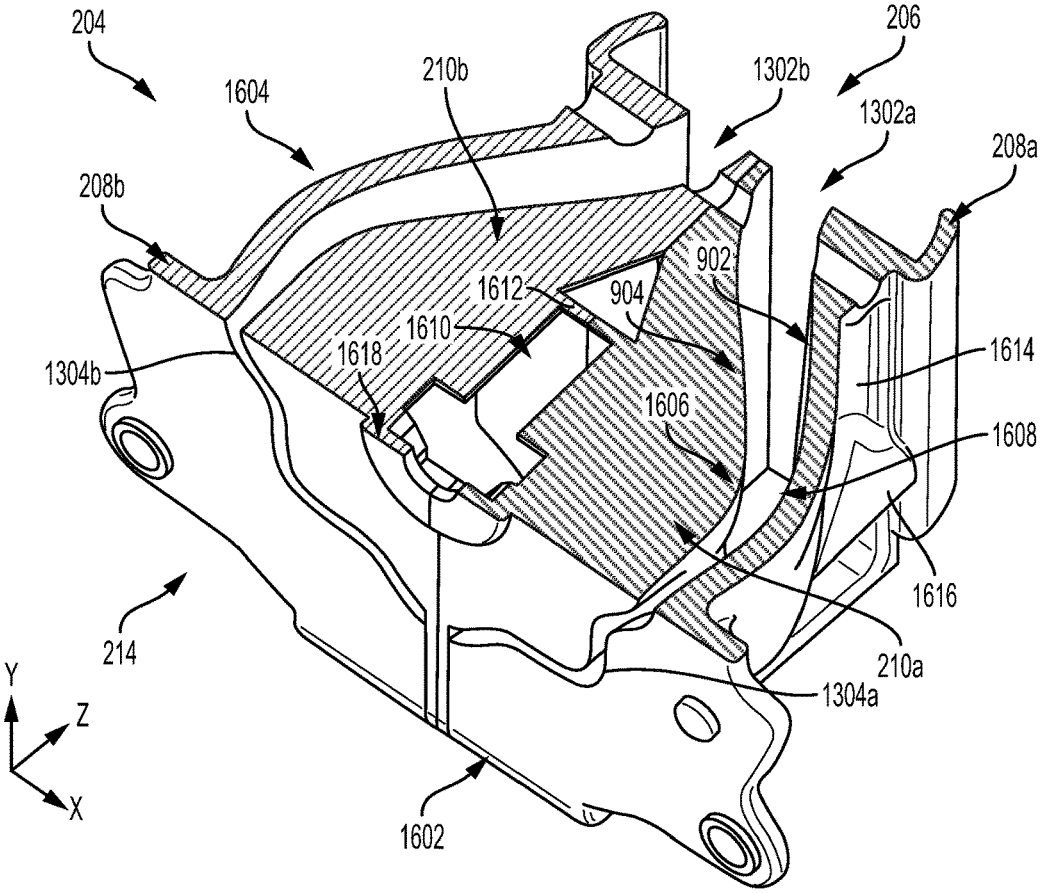
FIGS. 16-21 show different cross sections taken through the waveguide of FIG. 2 in accordance with one or more embodiments of the present disclosure.
Figure 17:
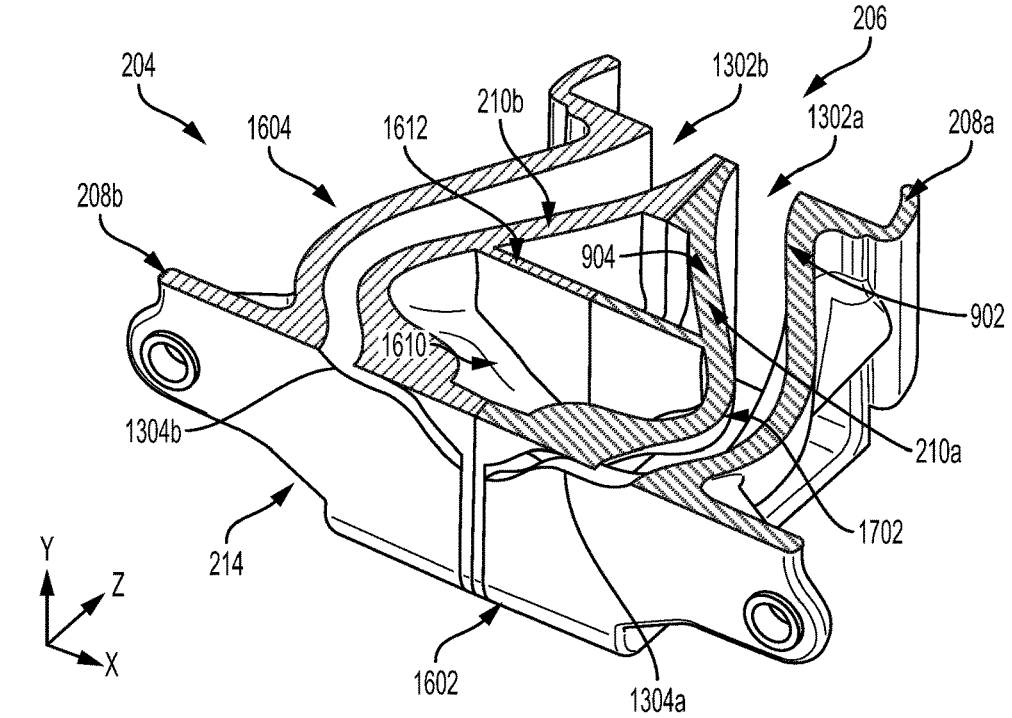
Figure 18:
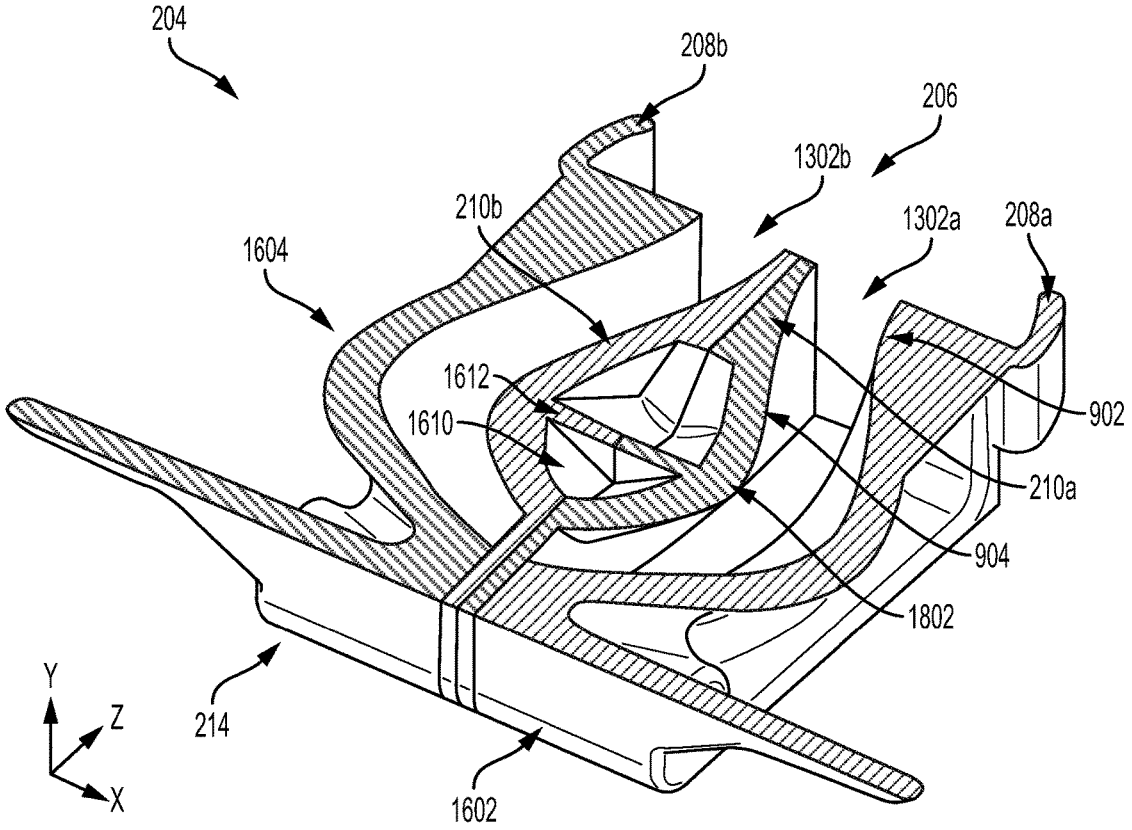
Figure 19:
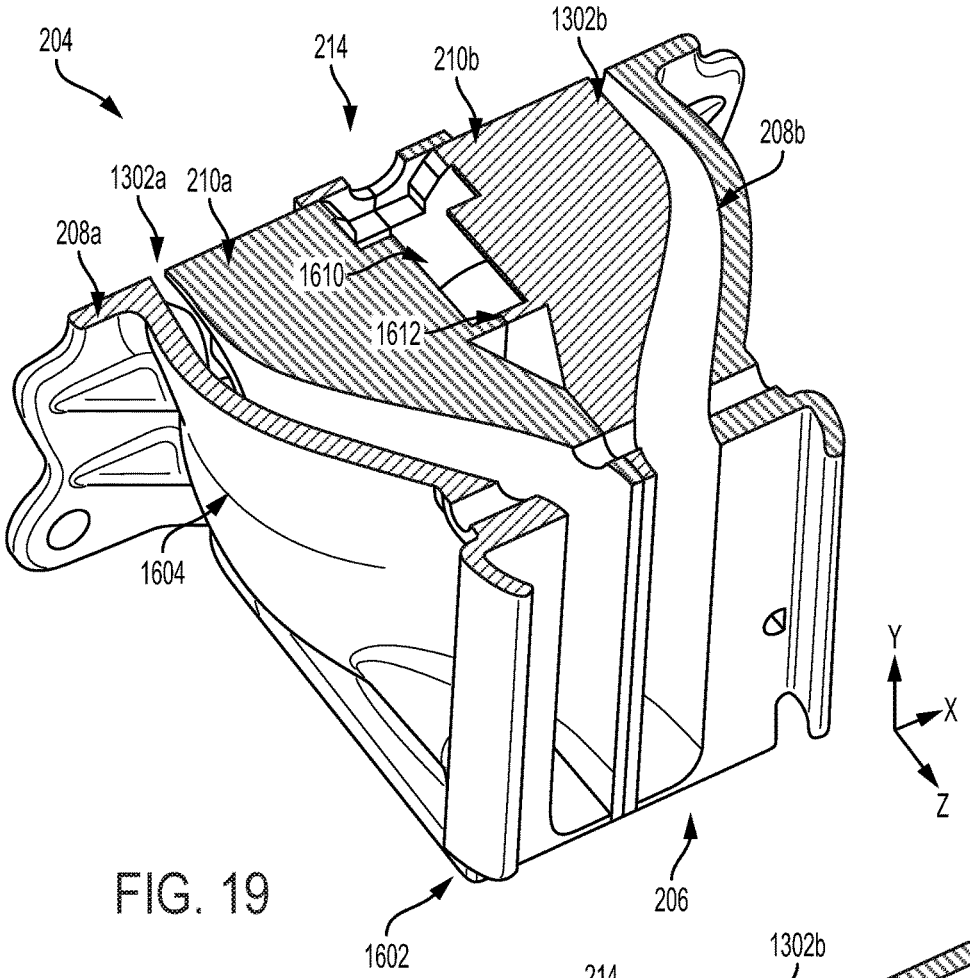
Figure 20:
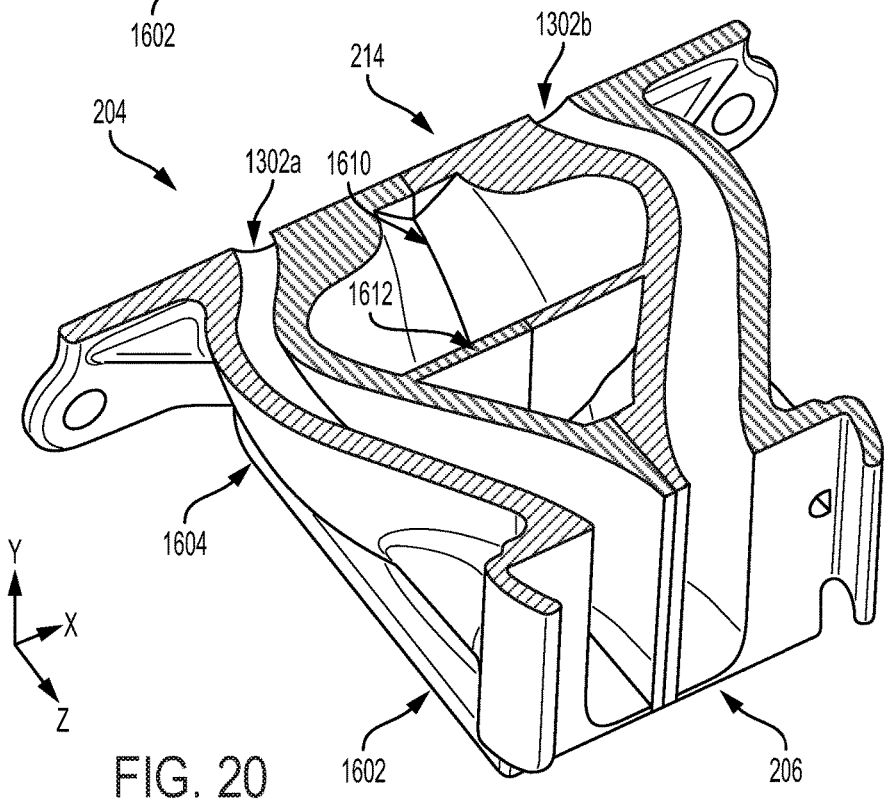
Figure 21:
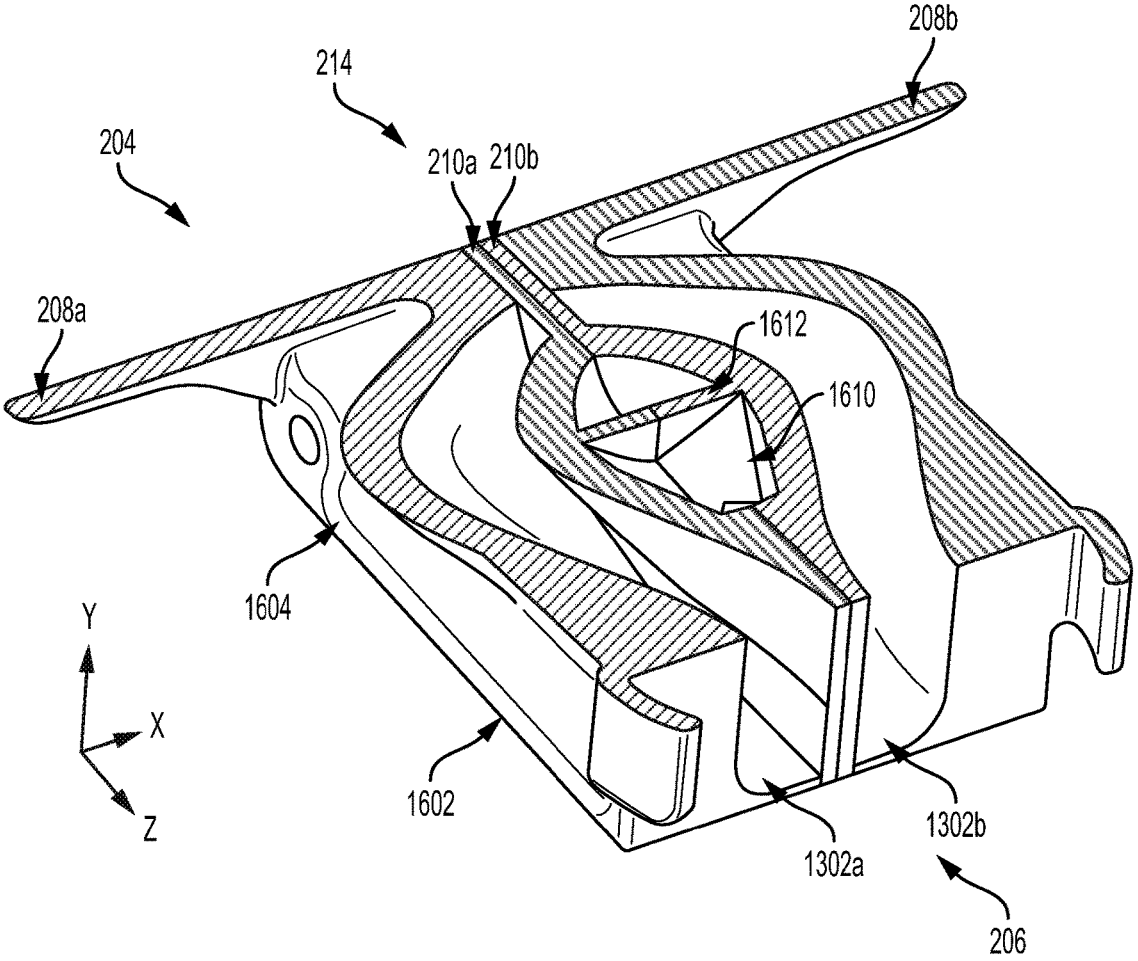

FIGS. 16-18 show different cross sections taken through the waveguide 204 of FIG. 2 at different heights (e.g., in the y-direction), as viewed from the inlet region 214 of the waveguide. FIGS. 19-21 show different cross sections taken through the waveguide 204 of FIG. 2 at different heights (e.g., in the y-direction), as viewed from the outlet region 206 of the waveguide. In each set of cross sectional views, the sound paths 1302 increase in width (e.g., in the x-direction, where the width of the sound paths is the distance between the interior surface of the outer shell and the exterior surface of the inner shell of a given outer-inner shell pair, such as outer shell 208*a* and inner shell 210*a*, at a particular location along the sound path in a generally z-direction from inlet region 214 to outlet region 206 of the waveguide and at a particular location along a generally y-direction from top to bottom of the waveguide). However, the degree to which the widths change varies at different cross sectional heights. For example, as shown in FIGS. 18 and 21, the paths 1302 are wider toward a bottom 1602 of the waveguide than toward a top of the waveguide (e.g., opposite of the bottom 1602 in the y-direction). In this way, the distance between the inner shells and the associated outer shells is greater in bottom section views than in higher section views. Furthermore, the paths 1302 are wider in a middle region 1604 of the waveguide (in an x-direction) than at the inlet region 214. As shown in FIGS. 18 and 21, the paths 1302 extend below openings in the inlet region.

As shown in FIG. 16, the top of the sound paths at cross-sectional plane through an approximate middle of the height of the waveguide may generally increase in width in the direction from the inlet region 214 to the outlet region 206. For example, the peripheral edge of the exterior surface 904 in the region of the cross-section shown in FIG. 16 is substantially linear from the inlet region 214 to a mid-point 1606. The peripheral edge of the exterior surface 904 then curves inward toward the inner shell 210*b* until reaching the outlet region 206. The peripheral edge of the interior surface 902 of the outer shell 208*a* curves out slightly from the inlet region 214 to a midpoint 1608 then curves in slightly to the outlet region 206. The inward curvature of the interior surface 902 is lesser than the inward curvature of the exterior surface 904, thereby increasing the width of the sound path 1302*a*. As the shells are symmetrical, a substantially same curvature is provided for outer and inner shells 208*b* and 210*b* as described above for outer and inner shells 208*a* and 210*a*.

As shown at 1610, a central region of inner shells 210*a* and 210*b* may be hollowed out to decrease weight and/or cost of the waveguide and/or to promote resiliency of the shells. One or more webs 1612 may separate openings in order to provide additional structural integrity for the waveguide and/or to provide a structural surface to which another portion of the waveguide and/or loudspeaker may be coupled to the inner shell. Similarly, external cutouts 1614 may be formed on the outer shell to reduce weight and/or cost of the waveguide and/or to promote resiliency of the shells. One or more supports 1616 may protrude from sections of the external surface of the outer shells to provide structural stability and/or to provide a structural surface to which another portion of the waveguide and/or loudspeaker may be coupled. Protruding ring 1618 may extend from an inlet-facing surface of the inner shells 210*a* and 210*b*, and may serve as a key or other coupling mechanism to couple the waveguide to a drive unit or other sound source.

In FIG. 17, which shows a cross-section of the waveguide 204 at a lower height than that of FIG. 16, the curvature of the inner shell 210 is more dramatic (e.g., changes by a greater amount) along the path from the inlet region 214 to the outlet region 206 relative to the curvature of the inner shell 210 at the cross-sectional height illustrated in FIG. 16. For example, from the inlet region 206 to a mid-point 1702, the edge of the exterior surface 904 curves outward (e.g., toward outer shell 208*a*). From the mid-point 1702 to the outlet region 206, the exterior surface 904 curves inward (e.g., toward inner shell 210*b*) by a greater amount than the exterior surface 904 at the higher cross-section of FIG. 16. The curvature of the interior surface 902 of the outer shell 208 at the cross-section shown in FIG. 17 is similar to that of the interior surface 902 at the cross-section shown in FIG. 16, with a slightly larger radius of curvature. However, the more dramatic curvature of the exterior surface 904 results in an overall increased sound path width relative to the sound paths at the cross-section shown in FIG. 16. The openings 1610 in the inner shells 210*a* and 210*b* are shown to be larger at the lower cross-section of FIG. 17 than the higher cross-section of FIG. 16.

In FIG. 18, which shows a cross-section of the waveguide 204 at a lower height than that of FIGS. 16 and 17, the curvature of the inner shell 210 is less dramatic (e.g., changes by a lesser amount) along the path from the inlet region 214 to the outlet region 206 relative to the curvature of the inner shell 210 at the cross-sectional heights illustrated in FIGS. 16 and 17. For example, from the inlet region 206 to a mid-point 1802, the edge of the exterior surface 904 curves outward (e.g., toward outer shell 208*a*). From the mid-point 1802 to the outlet region 206, the exterior surface 904 curves inward (e.g., toward inner shell 210*b*) by a lesser amount than the exterior surface 904 at the higher cross-section of FIGS. 16 and 17. The curvature of the interior surface 902 of the outer shell 208 at the cross-section shown in FIG. 18 is more dramatic than that of the interior surface 902 at the cross-section shown in FIGS. 16 and 17, with a much larger radius of curvature. The combined lesser radius of curvature of the exterior surface 904 and the greater curvature of the interior surface 902 results in an overall increased sound path width relative to the sound paths at the cross-section shown in FIGS. 16 and 17. Similar relative path widths and surface curvatures to those shown in FIGS. 16-19 are illustrated in FIGS. 19-21.

Figure 22A:
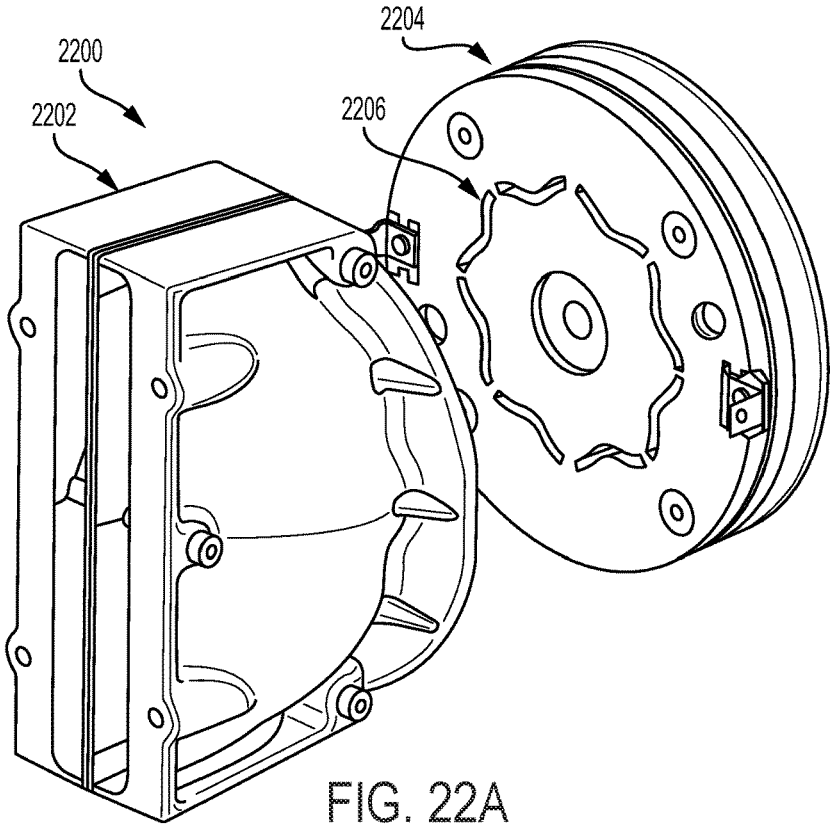
FIGS. 22A and 22B show different views of an example waveguide coupled to a driver unit in accordance with one or more embodiments of the present disclosure.
Figure 22B:
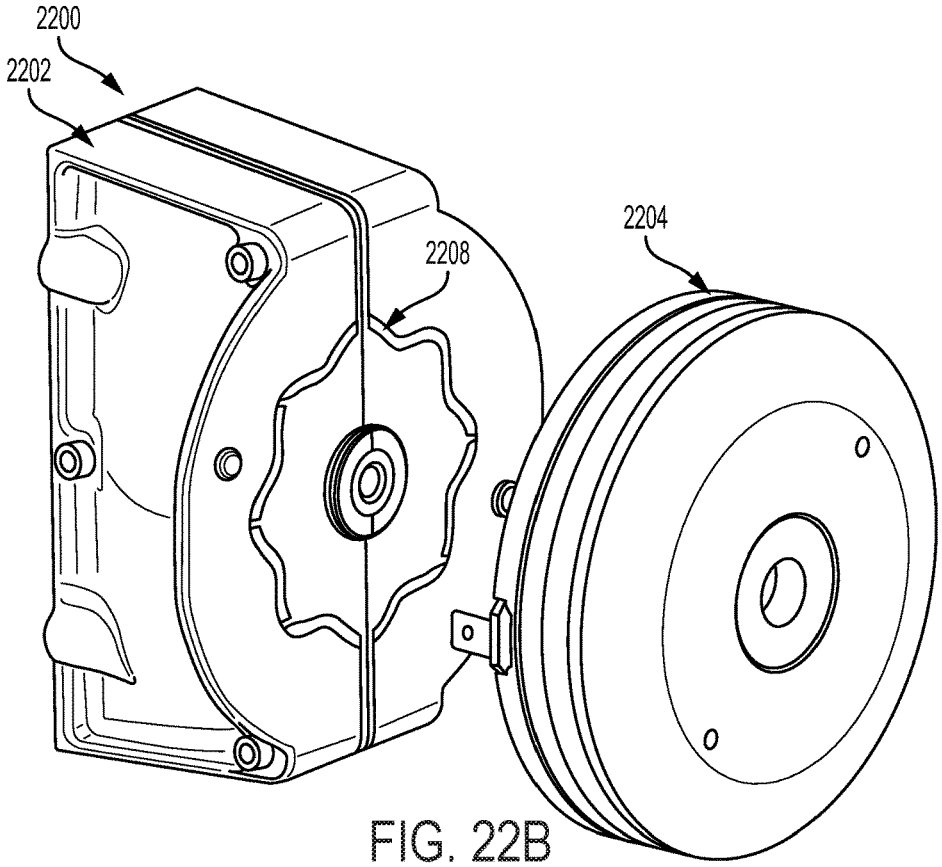

FIGS. 22A and 22B show an outlet-side view and an inlet side view, respectively, of an example waveguide 2202 coupled to a driver unit 2204 in a loudspeaker 2200. The waveguide 2202 may be an example of waveguide 204 of FIG. 2, and some or all of the above description of waveguide 204 may apply to waveguide 2202. The driver unit 2204 may be an example of driver unit 202 of FIG. 2, and some or all of the above description of driver unit 202 may apply to driver unit 2204. As shown, the driver unit 2204 may include outlet openings 2206 configured to output sound waves to the waveguide 2202. The outlet openings 2206 may be shaped and positioned similarly to inlet openings 2208 of the waveguide 2202. In the illustrated example, the outlet openings 2206 may be discontinuous, with solid material positioned between sections of a sinusoidal ring, whereas inlet openings 2208 of the waveguide 2202 may be continuous to form an uninterrupted sinusoidal ring. Similarly-paired openings may be used in example configurations with circular inlet openings of the waveguide.

Figure 23:
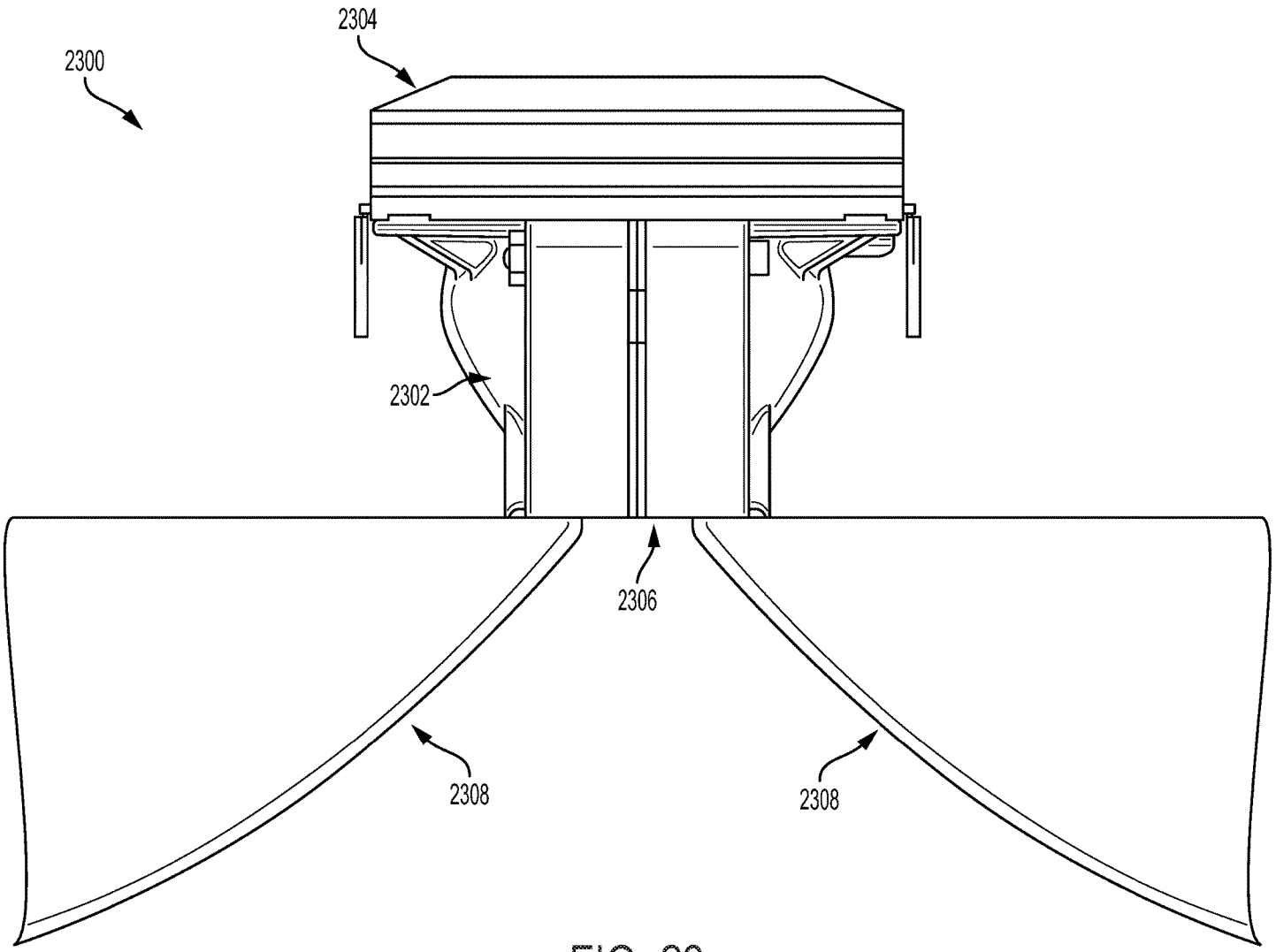
FIG. 23 shows an example configuration of a loudspeaker including a waveguide in accordance with one or more embodiments of the present disclosure.
Figure 24:
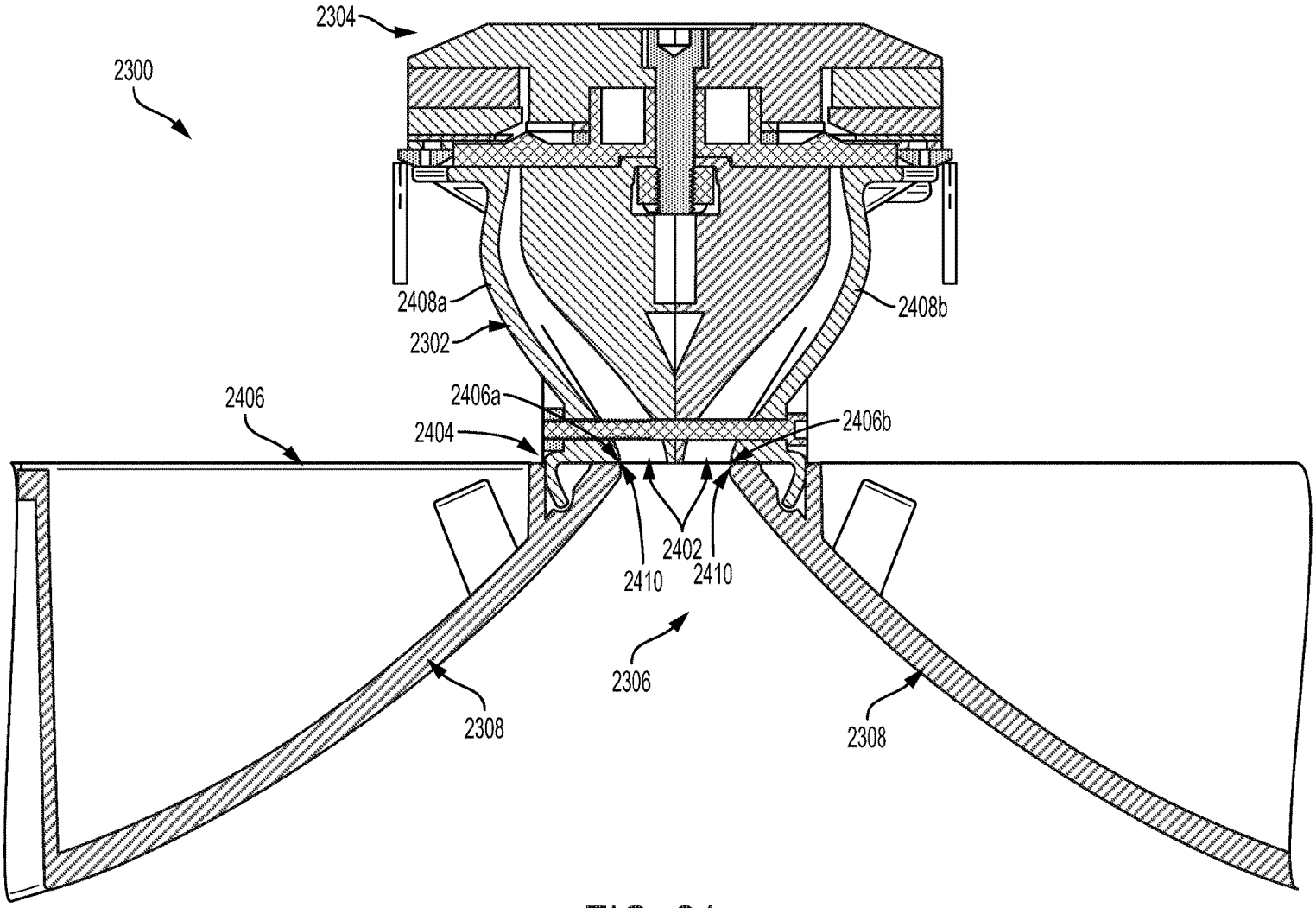
FIG. 24 shows a cross section view of the loudspeaker of FIG. 23 in accordance with one or more embodiments of the present disclosure.

FIG. 23 shows an example configuration of a loudspeaker 2300 including a waveguide 2302 coupled to a driver unit 2304. The waveguide 2302 may be an example of waveguide 204 of FIG. 2, and some or all of the above description of waveguide 204 may apply to waveguide 2302. The driver unit 2304 may be an example of driver unit 202 of FIG. 2, and some or all of the above description of driver unit 202 may apply to driver unit 2304. As shown, the outlet region 2306 of the waveguide 2302 is coupled to a mouth 2308 of the loudspeaker. The mouth 2308 may be an example of mouth 112 of FIG. 1, and the description of mouth 112 may apply to mouth 2308. For example, the mouth 2308 may provide a surface for guiding sound output by the waveguide 2302. FIG. 24 shows a cross sectional view of the loudspeaker 2300, illustrating sound wave paths 2402 that travel through the waveguide 2302 and out toward the mouth 2308. The cross sectional view of FIG. 24 also illustrates a coupling mechanism 2404 by which the waveguide 2302 may be coupled to a housing 2406 of the loudspeaker associated with the mouth 2308. The coupling mechanism 2404 may also help to align the openings at the outlet region 2306 with the mouth 2308 such that each edge or periphery 2406*a* and 2406*b* of the outer shells 2408*a* and 2408*b*, respectively, is flush with an edge or periphery 2410 of the mouth 2308. In this way, the mouth 2308 may not impede the flow of sound directly at the exit of the waveguide.

Figure 25:
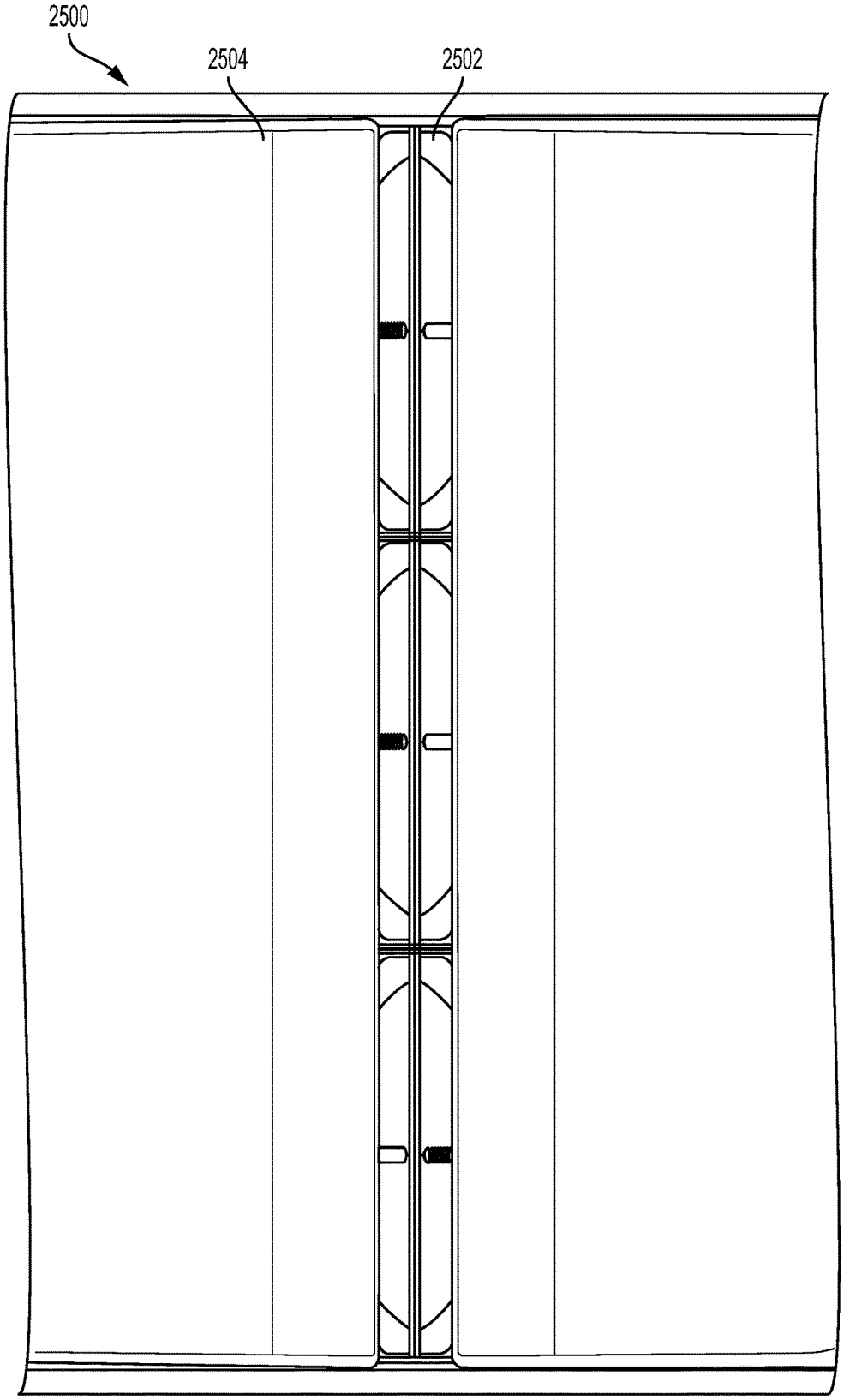
FIG. 25 shows an array of waveguides installed in a loudspeaker in accordance with one or more embodiments of the present disclosure.

FIG. 25 shows an example loudspeaker 2500 including an array of waveguides 2502 positioned within a housing 2504. In the illustrated example, the array of waveguides are stacked vertically and directly adjacent to one another (e.g., with no intervening air and/or structure). In other examples, other arrangements may be used to produce a selected sound output shape and pattern. The waveguides 2502 may be examples of waveguide 204 of FIG. 2, and some or all of the above description of waveguide 204 may apply to waveguides 2502.

The above-described loudspeaker systems may reduce the amount of sound directed from a loudspeaker to non-useful locations (e.g., areas away from a primary listening area, such as above the loudspeaker in some arrangements), by employing waveguides that provide equal sound path lengths in substantially all directions to create equal length channels where sound can travel from a sound output source of the loudspeaker (e.g., an inlet of the waveguide) to a sound exit of the loudspeaker (e.g., an outlet of the waveguide). The technical effect of these features is that increased control may be provided over the sound propagation in relation to systems that utilize waveguides with equal path lengths in only one plane, resulting in increased sound production efficiency for a given listening area.

The systems and methods described above also provide for a waveguide for a loudspeaker, the waveguide including an outer shell, and an inner shell coupled to the outer shell, a first end of the inner shell and a first end of the outer shell forming a first continuous ring defining a periphery of an inlet opening to an air gap between an interior surface of the outer shell and an exterior surface of the inner shell, a second, opposite end of the inner shell and a second, opposite end of the outer shell forming a second continuous ring defining a periphery of an outlet opening of the air gap, each of a plurality of three-dimensional paths between virtual points at the inlet opening of the air gap and virtual points at the outlet opening of the air gap having a substantially equal path length. In a first example of the waveguide, the first continuous ring may additionally or alternatively form a substantially sinusoidal curve and the virtual points at the inlet opening of the air gap may additionally or alternatively be located along the sinusoidal curve within the first continuous ring and in a plane that is coplanar with the first end of the inner shell and perpendicular to a center of the first continuous ring. A second example of the waveguide optionally includes the first example, and further includes the waveguide, wherein the second end of the inner shell forms a first side of a rectangle, and the second end of the outer shell forms remaining three sides of the rectangle. A third example of the waveguide optionally includes one or both of the first example and the second example, and further includes the waveguide, wherein the rectangle includes at least one rounded edge. A fourth example of the waveguide optionally includes one or more of the first through the third examples, and further includes the waveguide, wherein each of the exterior surface of the inner shell and the interior surface of the outer shell forms a continuous, smooth surface having a plurality of convex protrusions and a plurality of concave depressions. A fifth example of the waveguide optionally includes one or more of the first through the fourth examples, and further includes the waveguide, wherein each of the plurality of paths have an equal path length extending between a virtual inlet plane and a virtual outlet plane, where the first continuous ring lies on the virtual inlet plane and the second continuous ring lies on the virtual outlet plane. A sixth example of the waveguide optionally includes one or more of the first through the fifth examples, and further includes the waveguide, wherein the first continuous ring is adapted to be coupled to a driver unit that produces sound waves for propagation through the waveguide.

The above-described systems and methods also provide for a loudspeaker including a driver unit, and a waveguide coupled to the driver unit, the waveguide comprising an outer shell and an inner shell coupled to the outer shell, a first end of the inner shell and a first end of the outer shell forming a first continuous ring defining a periphery of an inlet opening to an air gap between an interior surface of the outer shell and an exterior surface of the inner shell, a second, opposite end of the inner shell and a second, opposite end of the outer shell forming a second continuous ring defining a periphery of an outlet opening of the air gap. In a first example, each of the exterior surface of the inner shell and the interior surface of the outer shell may additionally or alternatively form a continuous, smooth surface having a plurality of convex protrusions and a plurality of concave depressions. A second example of the loudspeaker optionally includes the first example, and further includes the loudspeaker, wherein the first continuous ring forms a substantially sinusoidal curve. A third example of the loudspeaker optionally includes one or both of the first example and the second example, and further includes the loudspeaker, wherein the second end of the inner shell forms a first side of a rectangle, and the second end of the outer shell forms remaining three sides of the rectangle. A fourth example of the loudspeaker optionally includes one or more of the first through the third examples, and further includes the loudspeaker, wherein the driver unit includes a plurality of outlet openings forming the sinusoidal curve. A fifth example of the loudspeaker optionally includes one or more of the first through the fourth examples, and further includes the loudspeaker, wherein each of a plurality of paths between virtual points at the inlet opening of the air gap and virtual points at the outlet opening of the air gap having a substantially equal path length. A sixth example of the loudspeaker optionally includes one or more of the first through the fifth examples, and further includes the loudspeaker, wherein each of the plurality of paths have a linear rate of expansion from the inlet side of the waveguide to the outlet side of the waveguide. A seventh example of the loudspeaker optionally includes the first through the sixth examples, and further includes the loudspeaker, wherein each of the plurality of paths have an exponential rate of expansion from the inlet side of the waveguide to the outlet side of the waveguide.

The above-described systems and methods also provide for a loudspeaker system including a plurality of driver units, and a plurality of waveguides, each of the waveguides coupled to one of the plurality of driver units, each of the waveguides comprising a first and second outer shell coupled to one another, and each of the waveguides comprising a first and second inner shell coupled to one another and positioned between the first and second outer shells, each of the outer and inner shells extending from an undulating ring at an inlet region of the waveguide to a rectangular opening at an outlet region of the waveguide via a continuous smooth surface having a plurality of convex protrusions and a plurality of concave depressions, the convex protrusions and concave depressions of an exterior surface of each first inner shell being positioned over convex protrusions and concave depressions of the interior surface of a respective complementary first outer shell to form an air gap between each complementary first inner shell and first outer shell. In a first example, the plurality of waveguides may additionally or alternatively be arranged in a vertical array on top of one another within a housing of the loudspeaker system. A second example optionally includes the first example, and further includes the loudspeaker system, wherein each of a plurality of paths between points at the inlet opening of the air gap and points at the outlet opening of the air gap having a substantially equal path length. A third example optionally includes one or both of the first and the second examples, and further includes the loudspeaker system, wherein the undulating ring at the inlet region of the waveguide forms a sinusoidal curve. A fourth example optionally includes one or more of the first through the third examples, and further includes the loudspeaker system, wherein the outlet side of the first inner shell forms a side of the rectangular opening, and the outlet side of the first outer shell forms remaining three sides of the rectangular opening rectangle, and wherein the interior surface of the first outer shell protrudes in a middle region of the waveguide relative to peripheral regions of the waveguide.

The description of embodiments has been presented for purposes of illustration and description. Suitable modifications and variations to the embodiments may be performed in light of the above description or may be acquired from practicing the methods. The described systems are exemplary in nature, and may include additional elements and/or omit elements. FIGS. 2-25 are shown to scale, although other relative dimensions may be used, if desired. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The term "substantially," as in "substantial equal to" for example, is used to account for tolerances due to mechanical precision considerations, and may refer to a value within 5% of the property being modified by the term "substantially." The following claims particularly point out subject matter from the above disclosure that is regarded as novel and non-obvious.

The invention claimed is:

1. A waveguide for a loudspeaker, the waveguide comprising:

an outer shell; and an inner shell coupled to the outer shell, a first end of the inner shell and a first end of the outer shell forming a first continuous annular ring defining a periphery of an inlet opening to an air gap between an interior surface of the outer shell and an exterior surface of the inner shell, a second, opposite end of the inner shell and a second, opposite end of the outer shell forming a second continuous ring defining a periphery of an outlet opening of the air gap, wherein the first continuous annular ring is only interrupted at a top region and a bottom region, each of a plurality of three-dimensional paths between virtual points at the inlet opening of the air gap and virtual points at the outlet opening of the air gap having a substantially equal path length.

2. The waveguide of claim 1, wherein the first continuous annular ring forms a substantially sinusoidal curve and wherein the virtual points at the inlet opening of the air gap are located along the sinusoidal curve within the first continuous annular ring and in a plane that is coplanar with the first end of the inner shell and perpendicular to a center of the first continuous annular ring.

3. The waveguide of claim 2, wherein the second end of the inner shell forms a first side of a rectangle, and the second end of the outer shell forms remaining three sides of the rectangle.

4. The waveguide of claim 3, wherein the rectangle includes at least one rounded edge.

5. The waveguide of claim 1, wherein each of the exterior surface of the inner shell and the interior surface of the outer shell forms a continuous, smooth surface having a plurality of convex protrusions and a plurality of concave depressions.

6. The waveguide of claim 1, wherein each of the plurality of paths have an equal path length extending between a virtual inlet plane and a virtual outlet plane, where the first continuous annular ring lies on the virtual inlet plane and the second continuous ring lies on the virtual outlet plane.

7. The waveguide of claim 1, wherein the first continuous annular ring is adapted to be coupled to a driver unit that produces sound waves for propagation through the waveguide.

8. A loudspeaker comprising:

a driver unit; and a waveguide coupled to the driver unit, the waveguide comprising an outer shell and an inner shell coupled to the outer shell, a first end of the inner shell and a first end of the outer shell forming a first continuous ring defining a periphery of an inlet opening to an air gap between an interior surface of the outer shell and an exterior surface of the inner shell, a second, opposite end of the inner shell and a second, opposite end of the outer shell forming a second continuous ring defining a periphery of an outlet opening of the air gap, wherein the first continuous ring is only interrupted at a top region and a bottom region.

9. The loudspeaker of claim 8, wherein each of the exterior surface of the inner shell and the interior surface of the outer shell forms a continuous, smooth surface having a plurality of convex protrusions and a plurality of concave depressions.

10. The loudspeaker of claim 8, wherein the first continuous ring forms a substantially sinusoidal curve, and wherein the first continuous ring is formed from a first continuous semi-circular curve extending uninterrupted from a first top termination point to a first bottom termination point and a second continuous semi-circular curve extending uninterrupted from a second top termination point to a second bottom termination point.

11. The loudspeaker of claim 10, wherein the second end of the inner shell forms a first side of a rectangle, and the second end of the outer shell forms remaining three sides of the rectangle.

12. The loudspeaker of claim 10, wherein the driver unit includes a plurality of outlet openings forming the sinusoidal curve, and wherein the first top termination point, the second top termination point, the first bottom termination point, and the second bottom termination point are defined by an intersection between the inner shell and the outer shell, the first top termination point being adjacent to the second top termination point, and the first bottom termination point being adjacent to the second bottom termination point.

13. The loudspeaker of claim 8, wherein each of a plurality of paths between virtual points at the inlet opening of the air gap and virtual points at the outlet opening of the air gap having a substantially equal path length.

14. The loudspeaker of claim 13, wherein each of the plurality of paths have a linear rate of expansion from an inlet side of the waveguide to an outlet side of the waveguide.

15. The loudspeaker of claim 13, wherein each of the plurality of paths have an exponential rate of expansion from the inlet side of the waveguide to the outlet side of the waveguide.

* * * * *